US006065828A

United States Patent [19]

Lo et al.

[11] Patent Number: 6,065,828

[45] Date of Patent: May 23, 2000

[54] SELECTABLE MIXING OF INKJET INK COMPONENTS

[75] Inventors: Clement C Lo, Oswego; James P Axtell, Portland, both of Oreg.

[73] Assignee: Hewlett-Packard Company, Palo Alto, Calif.

[21] Appl. No.: 08/806,991

[22] Filed: Feb. 26, 1997

[51] Int. Cl.[7] ..... B41J 2/175

[52] U.S. Cl. ..... 347/85

[58] Field of Search ..... 347/84, 85, 21, 347/20, 43; 222/81, 144.5, 160, 163

[56] References Cited

U.S. PATENT DOCUMENTS

| | | | |
|---|---|---|---|
| 3,596,801 | 8/1971 | Barnack | 222/81 |
| 3,858,580 | 1/1975 | Ogle | 222/81 |
| 5,371,529 | 12/1994 | Eguchi et al. | 347/7 |
| 5,409,141 | 4/1995 | Kikuchi et al. | 222/81 |
| 5,515,141 | 5/1996 | Hanson | 355/256 |

FOREIGN PATENT DOCUMENTS

| | | | |
|---|---|---|---|
| 0655337A2 | 11/1994 | European Pat. Off. | B41J 2/205 |
| 63-188056 | 8/1988 | Japan | 347/20 |
| WO97/09176A1 | 8/1996 | WIPO | B41J 2/175 |

*Primary Examiner*—N. Le
*Assistant Examiner*—Judy Nguyen
*Attorney, Agent, or Firm*—Flory L. Martin

[57] ABSTRACT

An ink replenishment system for an inkjet printing mechanism has an ink reservoir that is removably receivable by the inkjet printing mechanism to deliver an ink composition to an inkjet printhead for printing. The ink reservoir contains a large volume of colorless ink vehicle and one or more smaller containers of colorant or other ink components separate from the vehicle. At the time of desired use, a user makes a selection which activates the selected colorant and/or other ink constituent to mix with the vehicle to produce the desired ink composition. This ink replenishment system may be used in a replaceable inkjet cartridge ink dispensing system, or in an off-axis ink dispensing system, and a method of accomplishing such ink replenishment is also provided.

138 Claims, 12 Drawing Sheets

FIG. 3
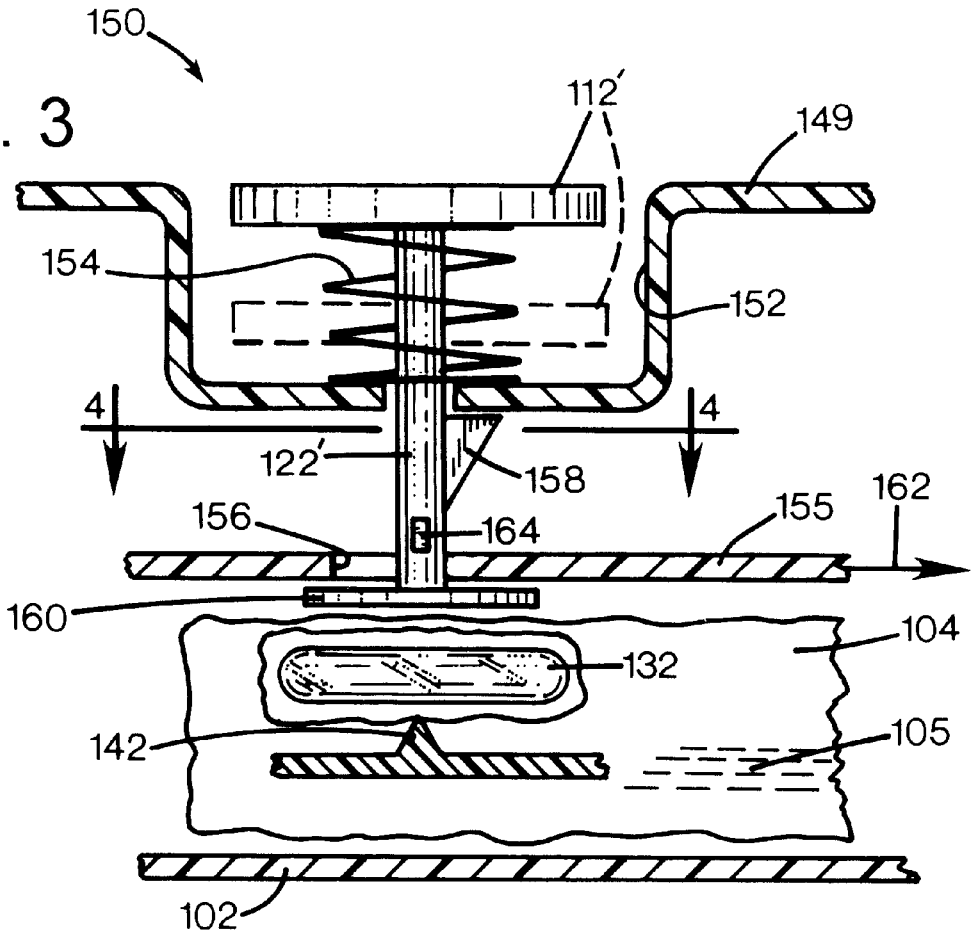
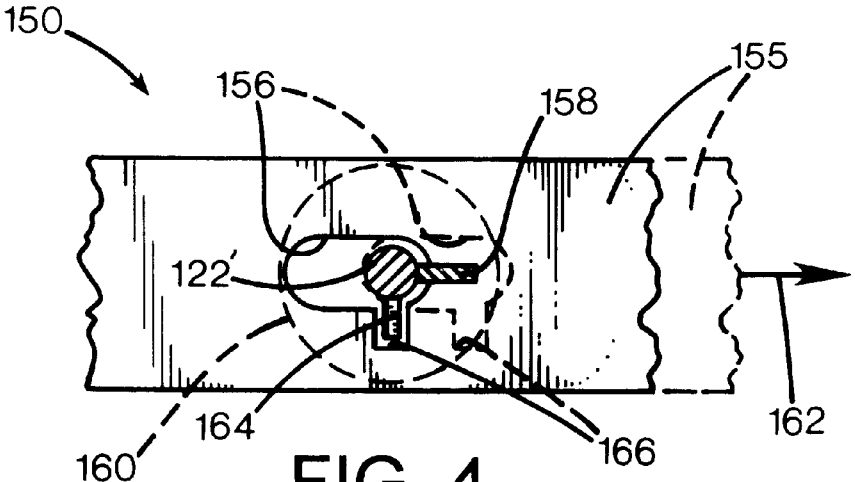
FIG. 4

SELECTABLE MIXING OF INKJET INK COMPONENTS

FIELD OF THE INVENTION

The present invention relates generally to inkjet printing mechanisms, and more particularly to a replaceable ink container holding a large volume of a liquid vehicle, along with one or more breakable smaller containers of colorant or other ink constituents which may be opened and mixed with liquid vehicle at the time of use to produce the desired ink composition.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper.

Typically, these inks are supplied in a reservoir housed by the inkjet cartridge, so when the pen is emptied, the entire cartridge is replaced. Some cartridges are monochrome (single color), for instance, carrying only black ink, while other cartridges are multi-color, typically carrying cyan, magenta and yellow inks. Some printing mechanisms use four monochrome cartridges, while others use a black monochrome cartridge in combination with a tri-color cartridge. Recently, an imaging cartridge system has been introduced by the Hewlett-Packard Company of Palo Alto, Calif., as the DeskJet® 693C model inkjet printer. This is a two-pen printer which uses a tri-color pen, carrying full dye-loads of cyan, magenta and yellow, and a black cartridge which may be replaced with a tri-color imaging cartridge. This imaging cartridge carries reduced dye-load concentrations of some colors, such as cyan and magenta, along with a full or partial dye-load concentration of black ink. The imaging cartridge allows the printer to produce more continuous tone changes, particularly flesh tones, so the resulting image has near-photographic quality, with very little graininess.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished, for example through tubing that delivers ink from an "off-axis" main reservoir placed at a remote, stationary location within the printer. Rather than purchasing an entire new cartridge which includes a costly new printhead, the consumer buys only a new supply of ink for the main reservoir. Typically, the fresh ink supplies are sold individually by color, although in some implementations, a multi-color supply may be furnished.

Both the multi-color and monochrome replacement schemes have advantages and disadvantages, whether they are offered as a replaceable cartridge, or as an off-axis supply. The combined multi-color system provides both the purchaser and the store with a single consumable item which is easily ordered, stocked, and replaced. The disadvantage of the multi-color modules is that some ink is always wasted because one color typically runs out before the others, resulting in a higher cost per page of printing for the consumer. The individual single color system solves the wasted ink problem by replacing only the empty color, but unfortunately, both the purchaser and the store must separately stock each color to ensure that the correct color ink is available when needed. This separate stocking issue has been compounded from the basic four colors (black, cyan, magenta and yellow) through the introduction of the imaging cartridge system, which also uses reduced dye-loads to produce multiple shades of cyan, magenta, yellow, or gray, or other formulations, such as red, green and blue inks, or perhaps other custom blended colors.

To obtain a full color gamut or a particular color hue, at some point from ink formulation to viewing of the final image, the desired colorants are mixed. Indeed, this whole issue of multiple shades of color, as well as custom blended colors, is one which has been addressed in varying degrees by the inkjet industry. In the earlier scenarios, four colors were mixed at the factory, specifically black, cyan, magenta and yellow. This system increased the color gamut available by using the eye to blend these basic colors into varying degrees of perceived shades and tones. To obtain better print quality and blending of shades, the printheads were then improved to deposit smaller droplets on a page, yielding more drops per unit area with more detail appearing in the resulting image. The use of the imaging cartridge which has various degrees of dye loads changed the amount of color deposited per drop by changing the saturation level of the colorant. One inkjet manufacturer has even mixed ink concentrations at the printhead, by adjusting the colorant concentration within the nozzle firing chamber, as described more fully in U.S. Pat. No. 5,371,529 and European Patent Application No. 0 655 337 A2. In this "blending in the printhead" system, the precise hue is ejected from the printhead, so the eye no longer needs to mix a group of colors to perceive the desired hue. Rather than using an elaborate printhead control scheme, it may be more desirable to blend a desired hue at the factory, and ship it directly to the customer. Such custom-blended colors may be particularly useful for industries where a particular color forms a portion of their trademark, or in other applications where particular colors are repeatedly used.

Another drawback of both the current multi-color and monochrome replacement schemes is that these inks often have a "shelf life." Currently, the ink compositions are pre-mixed by the manufacturer, and they must retain their composition and consistency from the time of manufacture until the time of use. Unfortunately, today's inks have a limited shelf life after which the compositions begin to decay, producing less than optimal print quality. Varying environmental conditions encountered during transport and storage may also adversely effect the more delicate ink constituents, leading to degraded print quality.

Thus, it would be desirable to provide a new system for supplying ink to consumers which avoids the wasted ink issue of the multi-color supplies, while also avoiding the stocking issues of the single-color supplies. It would also be desirable for such a new system to provide ink compositions with extended shelf lives to produce images of optimal quality, as well as to provide ink compositions with custom-blended colors.

SUMMARY OF THE INVENTION

According to one aspect of the present invention, an ink replenishment system is provided for an inkjet printing mechanism. The replenishment system has an ink reservoir that is removably receivable by the inkjet printing mechanism to deliver an ink composition to an inkjet printhead. The replenishment system also has an ink vehicle contained within the reservoir, and an ink constituent mixable with the ink vehicle to obtain the ink composition. The system further includes an introduction mechanism that selectively introduces the ink constituent into the ink vehicle within the reservoir. Preferably, the introduction mechanism substantially isolates the ink constituent from the ink vehicle prior to introduction.

According to another aspect of the present invention, an inkjet printing mechanism is provided as including an inkjet printhead that selectively ejects an ink composition to print an image. The printing mechanism also has a receptacle, and an ink reservoir removably receivable by the receptacle to deliver the ink composition to the inkjet printhead. An ink vehicle is contained within the reservoir. The printing mechanism further includes an ink constituent mixable with the ink vehicle to obtain the ink composition, and an openable container located inside the reservoir. The openable contained substantially isolates the ink constituent from the ink vehicle before the container is opened to introduce the ink constituent into the ink vehicle.

According to a further aspect of the present invention, a method is provided for replenishing an ink supply of an inkjet printing mechanism by combining plural ink components of an ink composition at the time of use. The method includes the steps of providing plural ink components comprising an ink vehicle and plural ink constituents, and thereafter, selecting one of the plural ink constituents. In an introducing step, the selected ink constituent is introduced into the vehicle. Finally, in a mixing step, the introduced ink constituent is mixed with the vehicle to produce the ink composition.

An overall goal of the present invention is to provide an ink replenishment system including a removable ink container for use in an inkjet printing mechanism, which allows a user to select a particular colorant, and/or release other ink constituents, at the time of desired use to print sharp vivid images for use in a replaceable cartridge system or in an off-axis ink supply system.

Another goal of the present invention is to provide an ink replenishment system for an inkjet printing mechanism which is easily ordered, inventoried and stocked both by stores and consumers, and preferably one which requires minimal shelf space for stocking a variety of colorant selections.

Still another goal of the present invention is to provide an inkjet ink replenishment system that has an extended shelf life.

A further goal of the present invention is to provide an ink replenishment system for an inkjet printing mechanism that economically allows customers to order custom-blended colors, which may be selected and mixed at the time of use.

BRIEF DESCRIPTION OF THE DRAWINGS

FIG. 3 illustrates one form of a colorant selection button, such as may be used at the dashed line locations of the buttons of FIG. 2, along with a selection indication and a lock-out mechanism, taken along lines 3—3 of FIG. 2.

FIG. 4 is a sectional side elevational view of the lock-out mechanism of FIG. 3, taken along lines 4—4 thereof.

DETAILED DESCRIPTION OF THE PREFERRED EMBODIMENTS

Figure 1:
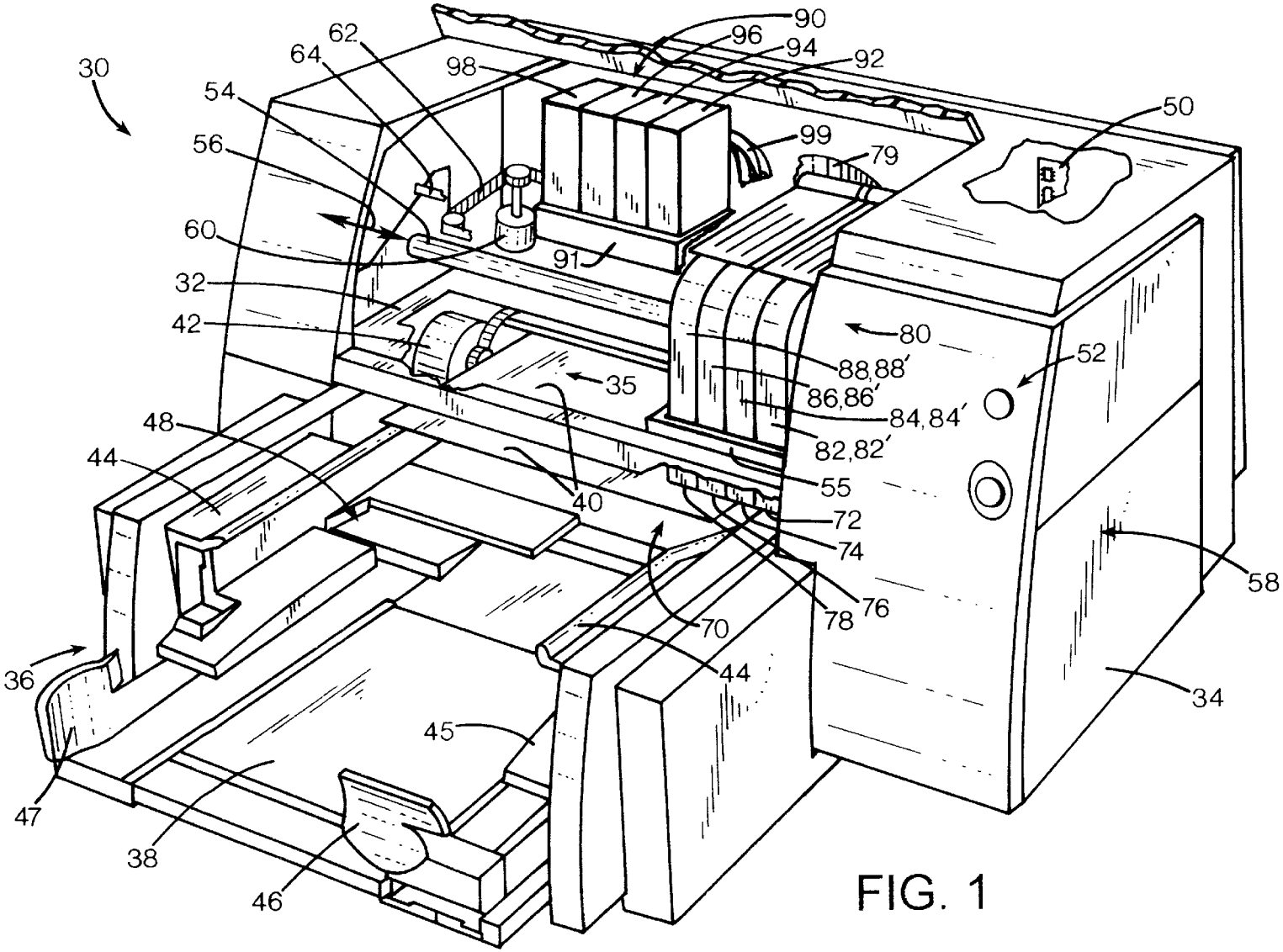
FIG. 1 is a perspective view of one form of an inkjet printing mechanism, here, an inkjet printer, schematically illustrating two alternate forms of ink dispensing systems, one using replaceable cartridges and the other using an off-axis system with replaceable ink supplies, either of which may employ an ink replenishment system of the present invention, several forms of which are illustrated in the following figures.

FIG. 1 illustrates an embodiment of an inkjet printing mechanism, here shown as an inkjet printer 30, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 30.

While it is apparent that the printer components may vary from model to model, the typical inkjet printer 30 includes a frame or chassis 32 surrounded by a housing, casing or enclosure 34, typically of a plastic material. Sheets of print media are fed through a print zone 35 by a media handling system 36. The print media may be any type of suitable sheet material, such as paper, card-stock, transparencies, mylar, and the like, but for convenience, the illustrated embodiment is described using paper as the print medium. The media handling system 36 has a feed tray 38 for storing sheets of paper before printing. Print media, such as sheet 40, is advanced by a series of conventional paper drive rollers (not shown) which are driven by a stepper motor and drive gear assembly 42, from the input tray 38 into the print zone 35 for printing. After printing, the motor 42 drives the printed sheet 40 onto a pair of retractable output drying wing members 44, shown in an extended position. The wings 44 momentarily hold the newly printed sheet 40 above any previously printed sheets still drying in an output tray portion 45, then the wings 44 retract to the sides to drop the newly printed sheet into the output tray 45. The media handling system 36 may include a series of adjustment mechanisms for accommodating different sizes of print media, including letter, legal, A-4, envelopes, etc., such as a sliding length adjustment lever 46, a sliding width adjustment lever 47, and an envelope feed port 48.

The printer 30 also has a printer controller, illustrated schematically as a microprocessor 50, that receives instructions from a host device, typically a computer, such as a personal computer (not shown). The printer controller 50 may also operate in response to user inputs provided through a key pad 52 located on the exterior of the casing 34. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 54 is supported by the chassis 32 to slideably support a quad inkjet printhead carriage system 55 for travel back and forth across the print zone 35 along a scanning axis 56. The carriage 55 is also propelled along the guide rod 54 into a servicing region, as indicated generally by arrow 58, located within the interior of the housing 34. A carriage drive gear and DC motor assembly 60 is coupled to drive an endless belt 62. The motor 60 operates in response to control signals received from the controller 50. The belt 62 may be secured in a conventional manner to the carriage 55 to incrementally advance the carriage 55 along the guide rod 54 in response to rotation of motor 60.

To provide carriage positional feedback information to printer controller 50, an encoder strip 64 extends along the length of the print zone 35 and over the service station area 58. A conventional optical encoder reader may also be mounted on the back surface of printhead carriage 55 to read positional information provided by the encoder strip 64. The manner of attaching the belt 62 to the carriage 55, as well as the manner providing positional feedback information via the encoder strip reader, may be accomplished in a variety of different ways known to those skilled in the art.

In the print zone 35, the media sheet 40 receives ink from one of more inkjet printheads of a printhead assembly 70, here shown as four printheads 72, 74, 76 and 78 transported by carriage 55. In some implementations, a single monochrome printhead may be used, while in others a monochrome printhead and a tri-color printhead may be used. To best illustrate the principles of the present invention, and to realize a great number of benefits, a four printhead system 70 is illustrated, with the first printhead 72 dispensing a black ink, and the remaining three printheads 74, 76 and 78 each dispensing a monochrome color ink, such as magenta, yellow and cyan. It is apparent that additional printheads may also be added, such as to provide a six printhead system for producing photographic quality images. In such a six printhead system, preferably the printheads 72–78 may each dispense full dye-load concentrations of black, magenta, yellow and cyan, while two additional imaging printheads may dispense reduced dye-load concentrations of cyan and magenta. Other colorant combinations may also be used. For instance, if the customer often printed grayscale images and a special custom-blended color, perhaps used as a trademark color, then the two additional printheads may dispense a reduced dye-load concentration of black, i.e. a gray ink, and the custom-blended color.

The printheads 72, 74, 76 and 78 each have an orifice plate with a plurality of nozzles which may be formed therethrough in a manner well known to those skilled in the art. The nozzles of each printhead 72–78 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 56, with the length of each array determining the maximum image swath for a single pass of the printheads across the print zone 35. The illustrated printheads 72–78 are thermal inkjet printheads, although other types of printheads may be used, such as piezoelectric printheads. The illustrated thermal printheads 72–78 typically include a plurality of resistors which are associated with the nozzles. Upon energizing a selected resistor, a bubble of gas is formed which ejects a droplet of ink from the nozzle and onto the sheet of paper 40 when in the print zone 35. The printhead resistors are selectively energized in response to firing command control signals delivered from the controller 50 to the printhead carriage 55 by a multi-conductor strip 79.

Figure 21:
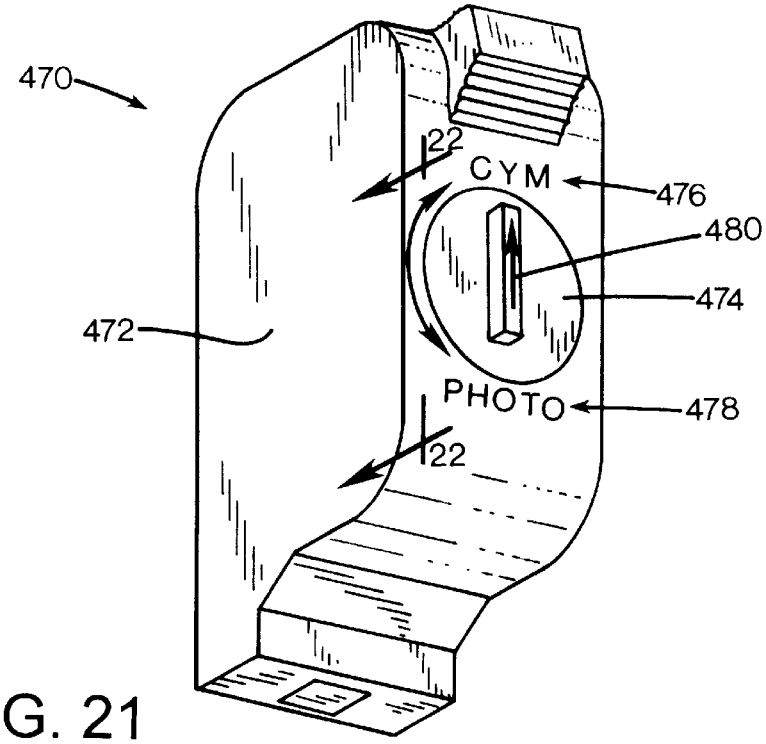
FIG. 21 is a perspective view of a ninth embodiment of an ink replenishment and dispensing system of the present invention, here showing a tri-color replaceable inkjet cartridge.
Figure 22:
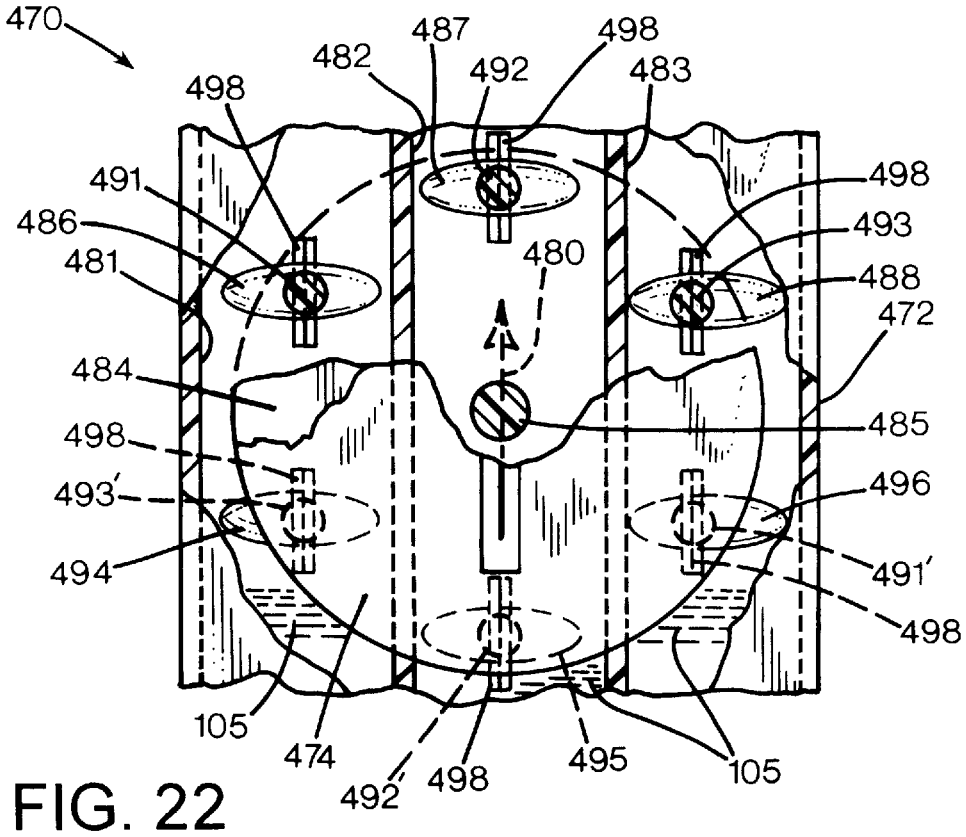
FIG. 22 is a sectional front elevational view taken along lines 22—22 of FIG. 21.

There are at least three different ways in which ink may be delivered to the printheads 72–78. First, the printheads 72–78 may each be part of four separate cartridges in a replaceable cartridge system 80, specifically, inkjet cartridges 82, 84, 86 and 88. In this system, each printhead is an integral part of the associated cartridge. For instance, printhead 72 is an integral part of replaceable cartridge 82. When the cartridge 82 is empty, the entire cartridge 82 is replaced, and a new cartridge, including a new printhead 72 is installed in carriage 55. These replaceable cartridges are also often called "pens" by those in the art. In the illustrated embodiment, the color cartridges 84, 86 and 88 are each separate cartridges, although in other embodiments, a tri-color cartridge may be used which has three reservoirs within a single cartridge containing three separate colors, such as cyan, yellow and magenta (FIGS. 21 and 22). Alternatively, for an imaging cartridge system, other reduced dye-load concentration cartridges may be used, such as one containing a reduced dye-load of cyan, magenta, and a full dye-load of black, particularly if such an imaging cartridge is used in place of the black ink cartridge 82 (FIGS. 21 and 22). As another alternative, a tri-chamber cartridge may carry other colors, such as custom-blended colors, a reduced dye-load of black, i.e. gray ink, and a full dye-load of black ink, particularly when such a cartridge is used in exchange for the black ink cartridge 82.

In the alternate off-axis ink delivery and dispensing system 90, also illustrated in FIG. 1, rather than each pen carrying the entire ink supply onboard the printer for a given color, they store only a small supply of ink. The off-axis system 90 uses four inkjet pens 82'–88', which may be of somewhat smaller dimensions than shown in FIG. 1 because they carry only a small supply of ink, while the main supply of ink is held within a container receptacle 91, that holds four replaceable ink supplies 92, 94, 96 and 98. Each of the replaceable ink supplies may contain the same colors as described above for the replaceable cartridges 82–88. When referring to the reservoirs carried by carriage 55 as being used in the off-axis system 90, they will be referred to as mini-reservoirs 82', 84', 86' and 88', which are each coupled to the associated printheads 72, 74, 76 and 78, respectively. To transport the ink from the replaceable supplies 92–98, the printer 30 includes an ink delivery conduit or other ink delivery transport mechanism, such as ink tubing 99. Here, the tubing 99 generally consists of four separate tubes or other conduit members, each coupling the ink supplies 92–98 to their respective mini-reservoirs 82'–88' which supply the associated inkjet printheads 72–78, respectively.

An off-axis system typically uses a semi-permanent printhead system 70, which has printheads 72–74 designed for a longer life than printheads supplied with the replaceable cartridge system 80. While the printheads in an off-axis system may be called "permanent" printheads, in reality they usually have a somewhat shorter life span than the other components of the printer 30, and they typically do need replacement at some point to maintain high print quality. Thus, the term used herein to distinguish the off-axis printheads is "semi-permanent," in contrast to the printheads in the replaceable cartridge system 80. Indeed, this term "semi-permanent" for the printheads even more broadly encompasses what are known in the art as "snapper" systems, which detachably "snap" a fresh supply onto a printhead-carrying carriage, then transport this detachable supply across the printzone. The printheads in a snapper system may also be "permanent" or capable of replacement during the life of the printer, i.e., "semi-permanent." Another way of distinguishing the off-axis and snapper systems from the totally replaceable cartridge system 80 is the attachable/detachable or removable engagement of the printhead from the reservoir in the off-axis and snapper systems. It is apparent to those skilled in the art that the ink replenishing systems described herein are clearly operable in these snapper systems, as well as in systems 80 and 90, illustrated herein.

Thus, the replaceable cartridge system 80 forms one manner of dispensing ink in the inkjet printer 30. This replaceable cartridge system 80 may be considered as a "on-axis" system, in contrast to the off axis system 90 which stores the main ink supply at a stationery location remote from the printzone scanning axis 56. The inks dispensed by either system 80 or 90 may be pigment-based inks or dye-based inks, as well as other types of inks, such as paraffin-based inks, hybrid inks, or composite inks having both dye and pigment characteristics. The concepts of the ink replenishment system described below with respect to FIGS. 2–25, may be implemented either in the replaceable cartridge, on-axis ink dispensing system 80, or in the off-axis ink dispensing system 90.

In typical inkjet ink compositions, such as a dye-based or a pigment-based ink composition, the colorants actually comprise only a small percentage of the total volume of the ink composition. The balance of ink composition typically comprises a colorless fluid, called a vehicle, which carries the colorant to the print media 40. A majority of this colorless ink vehicle is often made of water, with the addition of various volatile components, such as alcohol. Both the water and the volatile components evaporate upon exposure to the air, leaving the colorants to adhere to page. These volatile constituents often determine the shelf-life of a factory-blended ink composition. In the factory-blended compositions, over time these volatiles may slowly leach through the molecular fabric of the ink container, leaving an aged ink composition with a deficiency of these volatiles. Each ink droplet then has a higher concentration of water and colorants with less volatiles, so the ink droplet from an aged composition does not print as well as one from a fresh ink composition. Thus, it is desirable to contain these volatile components within a volatile-impervious container as long as possible, such as until the time of use. Then at use, these volatiles may be released into the remaining ink vehicle to print with a fresh mixture, which has not degraded over time through this molecular permeation.

Besides releasing volatiles at the time of use, it is also desirable to allow a user to select which colorant to mix with the ink vehicle at the time of use. In this manner, a single multi-color capable ink container may be stocked by stores and purchased by consumers, with the consumer determining at the time of use exactly which colorant to select and mix with the ink vehicle to produce the desired color of ink. This system then allows both stores and consumers to devote less storage space and resources to stocking a variety of different colors. Furthermore, custom-blended colors may be provided in an economical fashion for business, industry and the like, who repeatedly use a particular hue or shade of color, and would like to apply that particular color to the print media rather than using the conventional mixing of cyan, magenta and yellow on the media to produce the desired hue.

In selecting one of several colorant choices, it would also be desirable for the ink replenishment system to provide a user with an indication of which particular colorant has been previously selected. Moreover, to prevent mixing of two or more colors within the ink replenishment container, it would be desirable to provide a lock-out mechanism so after a single color is selected, no further colorants can be added to the composition. While the selection may be made by a user, in some implementations, it may be preferable to have the inkjet printing mechanism make the proper selection of colorant at the time of use. Furthermore, after the selection has been made, and the colorant and/or volatiles introduced to the ink vehicle, that is after the activation stage, a mixing step may be desirable. This mixing may be accomplished by merely letting the colorant and/or volatiles disperse through the ink vehicle by waiting a certain length of time. However, it may be desirable to provide some sort of additional mixing action, for instance by the operator shaking the replenishment container, or in an automatic selection system, having the inkjet printing mechanism provide this mixing function.

The following embodiments of FIGS. 2–25 accomplish these objectives, and they are illustrative of the many different ways in which the concepts of the present invention may be employed. These embodiments also illustrate a method of replenishing an inkjet ink supply by blending ink components at the time of use, rather than at the factory. These embodiments illustrate a variety of different manners of performing a selection step, an activation step and a mixing step to blend the ink constituents at the time of use, as well as indication and lock-out steps.

First Embodiment

Figure 2:
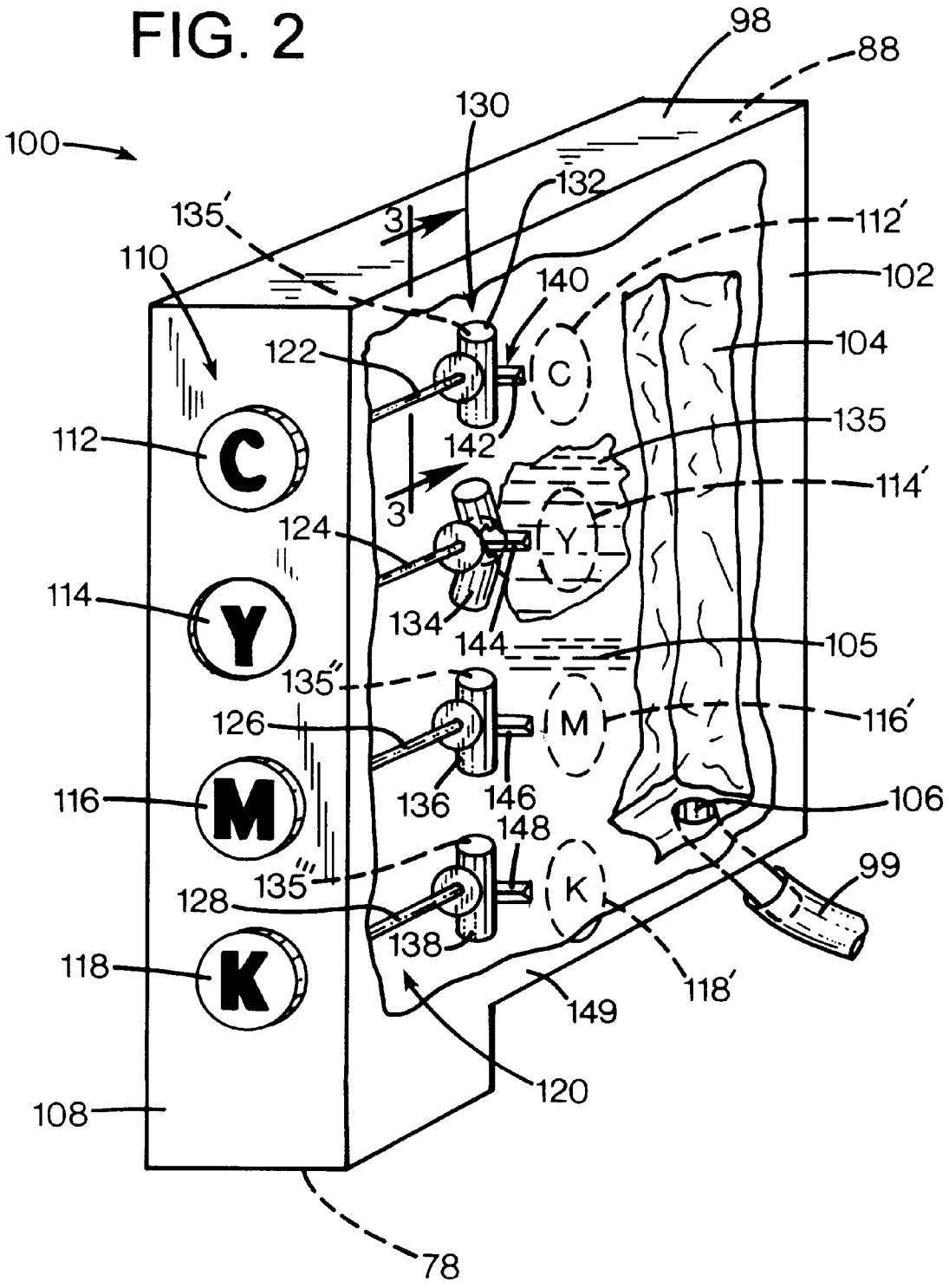
FIG. 2 is a partially schematic, fragmented perspective view of a first embodiment of an ink replenishment system of the present invention, showing two alternate locations, one in solid lines and one in dashed lines, for colorant selection buttons.

FIG. 2 illustrates a first embodiment of an ink replenishment system 100 constructed in accordance with the present invention. The ink replenishment system 100 includes an ink reservoir defined by a rigid body or casing 102, for instance of a plastic material, which may be optionally lined with a flexible bladder or liner bag 104 of a plastic, foil or other collapsible flexible material. The reservoir encompassed by the liner bag 104 is preferably filled with a colorless ink vehicle 105 that may or may not contain volatile components, which evaporate at printing, as discussed above. For the purposes of discussion, it is assumed the ink vehicle 105 is supplied with these volatiles, although it will be apparent from the discussion below that these volatiles may be added at time of use. The replenishment system 100 may be fashioned as a replaceable inkjet cartridge 88 having a printhead 78, as illustrated in dashed lines, for use in an on-axis system 80. Alternatively, the ink replenishment system 100 may be equipped with an outlet port 106 to which a portion of the ink delivery tubing 99 is coupled to supply the ink to the mini-reservoir 88' onboard the carriage 55.

In the view FIG. 2, the casing body 102 has a front wall 108 which serves as a mounting point for a colorant selection system 110, here comprising a set of push buttons 112, 114, 116 and 118 for selecting the colors cyan, yellow, magenta and black (C, Y, M, K), respectively. Each of the push buttons 112–118 are coupled to an activation device, such as a series of push rods 120, here comprising rods 122, 124, 126 and 128. Secured within the casing body 102 and the optional liner bag 104 are colorant housing system 130 comprising a series of openable colorant containers, which may be of any type of rupturable or breakable material, for instance such as a series of glass vials. The illustrated colorant housing system 130 includes a cyan colorant vial 132, a yellow vial 134 containing a yellow colorant 135, a magenta colorant vial 136, and a black colorant vial 138.

The colorant vials may be secured against the interior surface of one of the walls of the body 102, and then broken when pushed upon by the pusher rod, such as rod 124. However, is believed preferable to promote breaking by pushing the selected vial against an impact point to concentrate the breaking force. This impact point may be provided by a series of breaker bars 140, including a cyan vial breaker bar 142, yellow vial breaker bar 144, magenta vial breaker bar 146 and a black vial breaker bar 148. In FIG. 2, the yellow selection button 114 has been depressed, causing activation as the push rod 124 forces the yellow vial 134 against the breaker bar 144 to break the vial and release the yellow liquid colorant 135 into the ink vehicle 105.

While the vials 132–138 may contain only colorant, it may also be preferable to supply both colorant and volatiles within these vials, assuming that the vials are of a material selected to contain the volatiles, for which glass may be quite suitable. Moreover, the glass vials 130 are easily ruptured by the push rod and breaker bar systems 120, 140. While the colorant selection buttons 112–118 are shown mounted along wall 108, a suitable alternate location for these buttons may be along wall 149, as indicated in dashed lines, for a cyan button 112', and yellow button 114', a magenta button 116' and a black button 118'. In such an alternate location, the breaker bars 142–148 may be located 90 degrees from that shown, to rest against the side of vials 132–138 that is opposite wall 149. Indeed, this alternate location for the color selection buttons 112'–118' is used to illustrate a selection indication and a lock-out system 150 in the views of FIGS. 3 and 4.

In FIG. 3, push button 112' is shown received within a recess 152 defined by the casing wall 149. To normally bias the selector button 112' in an inactivated state, the assembly 150 includes a biasing member, such as a spring 154, which pushes the head of button 112' away from the bottom portion of the recess 152. In the illustrated embodiment, a sliding locking plate 155 is mounted within the interior of the casing body 102, but exterior to the ink containment bag 104. The locking plate 155 defines a keyhole slot 156 through which the push rod 122' extends. Mounted along one side of the push rod 122' is a ramped lock activation member 158 which also serves to secure the button 112' in a lowered position inside the recess 152 after activation. Upon pushing button 112' downwardly into recess 152, a foot portion 160 of the push rod 122' forces the cyan colorant containing vial 132 against breaker bar 142 to release the cyan colorant 135' into the ink vehicle 105. As the push rod 122' travels downwardly through slot 156, the ramped portion of the lock activator 158 pushes the locking plate 155 to the right, as indicated by arrows 162 in FIGS. 3 and 4. The final resting location of the locking plate 155 and the head of button 112' are shown in dashed lines in FIGS. 3 and 4.

Before the activator ramp 158 contacts the locking plate 155, an indicator key portion 164 extending from shaft 122' first passes through a keyhole portion 166 of slot 156, shown in FIG. 4. After passage of the key 164 through the keyhole slot 166, the ramp 158 then moves the locking plate to a locked position where the indicator key 164 is trapped underneath the locking plate 155. By trapping key 164 under plate 155, the head of button 112' remains depressed at the position shown in dashed lines in FIG. 3 to indicate which color has been selected and released into the ink vehicle 105. Thus, this lock-out and indication system 150 provides a permanent record as to which colorant, if any, has been released into the vehicle 105.

Movement of the locking bar 155 in the direction indicated by the arrow 162 then blocks the other remaining selector buttons 114', 116', 118' from being depressed, assuming the buttons 114'–118' are constructed as shown in FIG. 3 along with the relative locations and configurations of the slots 156, 166. That is, after the locking bar 155 moves to the right as indicated by arrow 162, then each of the keys 164 on the push rods for the remainder of the buttons 116'–118' are no longer aligned with their respective keyhole slots 166. Thus, the keys 164 prevent the other buttons 116'–118 ' from being depressed, which advantageously avoids mixing of other colorants with the selected cyan color. Selection of any of the other colorant buttons 116'–118' instead of the cyan button 112' also serves to move the locking plate 155 into the locked position to block activation of the remainder of the buttons. Thus, this lock-out and indication system 150 prevents muddying of the resulting ink composition by stopping activation of more than one colorant.

Second Embodiment

Figure 5:
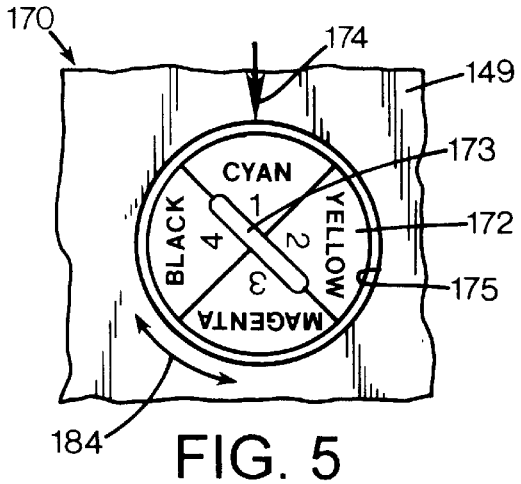
FIG. 5 is a side elevational view of a second embodiment of an ink replenishment system of the present invention, here having an alternate colorant selection system which may be substituted for that shown in FIGS. 3 and 4.
Figure 6:
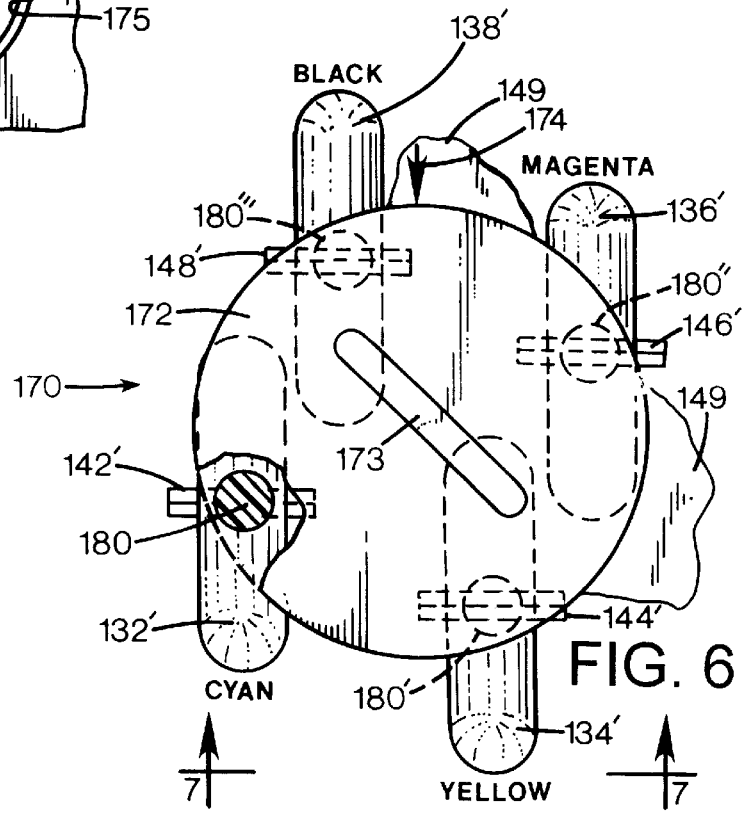
FIG. 6 is a side elevational view of the colorant selection system of FIG. 5, fragmented to illustrate the operation thereof.
Figure 7:
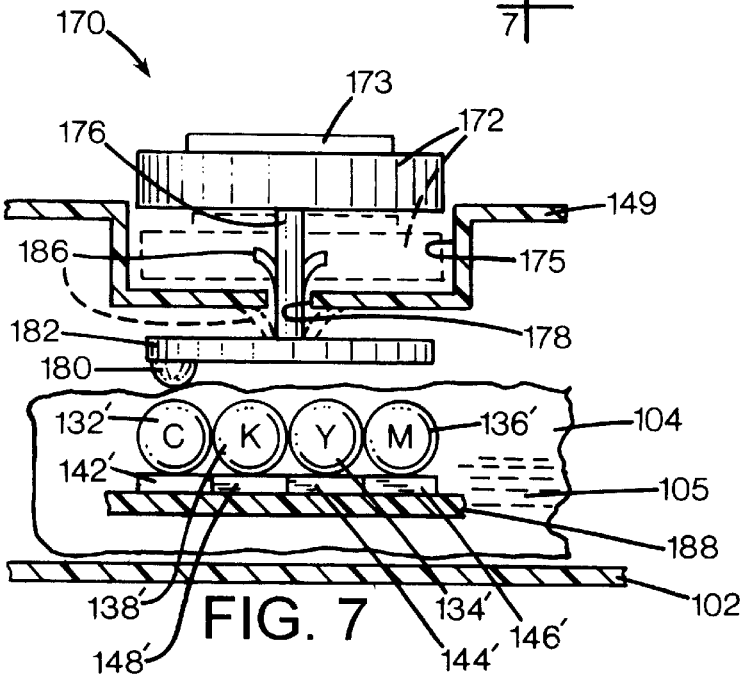
FIG. 7 is a sectional bottom plan view of the colorant selection system of FIGS. 5 and 6 taken along lines 7—7 of FIG. 6 and illustrating an alternate lock-out and selection indication mechanism.

FIGS. 5–7 illustrate a second embodiment of a colorant selection system 170 constructed in accordance with the present invention, which may be used in place of the selection system 110 within the body 102, for instance along wall 108, or here along wall 149. Rather than the push button selector system 110, system 170 uses a rotating selector switch or dial 172 having a handle 173. The face of the dial 172 is divided into four pie-shaped regions, each carrying an indicia or label to indicate which colors may be selected. The labels on the dial 172 may be used in conjunction with a stationary indicator, such as a pointer 174 located on the wall 149, to provide an indication as to which colorant has been selected, here cyan. Indeed, rather than labeling the selector dial 172 with the names of the colorants (cyan, yellow, magenta and black), it may be preferable instead just to place patches of these colors on the surface of the selector switch 172, since many ordinary users are not familiar with the names "cyan" and "magenta." This is also true for the push button system 110 of FIG. 2, as well as other embodiments described herein; however, for those skilled in the art, use of these color names and their abbreviations (C, Y, M, K) are quite familiar and are used herein.

In this rotary selector switch system 170, the colorant vials may be constructed as described above for vials 132–138, although they are secured in a slightly different arrangement within the casing body 102 as shown in FIG. 6 (and more schematically in FIG. 7) as a cyan vial 132', a yellow vial 134', a magenta vial 136' and a black vial 138'. Given this alternate arrangements of vials 132'–138', the location of the breaker bars also varies from that in FIG. 2. Here, the breaker bars 142', 144', 146' and 148' are located to break their associated the vials 132', 134', 136' and 138', respectively.

As shown in FIG. 7, the selector dial 172 is preferably received within a recess 175 defined by the casing wall 149. The selector switch 172 has a shaft 176 which extends through a hole 178 defined by the bottom wall of the recess 175. The selector switch 172 also has an activation member, such as a breaker protrusion or bump 180 projecting from a lower surface of a breaker disk portion 182 attached to the end of shaft 176. In the views of FIGS. 6 and 7, the breaker protrusion 180 is shown located above the cyan vial 132', opposite the breaker bar 142'. FIG. 6 shows alternate locations for the breaker bump 180, as position 180' over the yellow vial 134'. Position 180' corresponds to a 90° counterclockwise turn of the selector switch 172, which as viewed in FIG. 5 places the yellow indicia on the switch 172 under the indicator 174. Similarly, a further 90° counterclockwise rotation of switch 172 places the magenta indicia under indicator 174 to locate the breaker bump 180 at position 180" over the magenta vial 136'. A final rotation of 90° counterclockwise brings the black indicia of switch 172 under indicator 174, to place the breaker bump 180 at location 180'" opposite the black vial 138'.

Once the colorant selection has been made by rotating the dial 172 in either direction, as indicated by the curved arrow 184 in FIG. 5, activation then occurs by pressing the selector dial 172 downwardly into recess 175. This downward motion of dial 172 forces the breaker bump 180 into contact with the selected vial, here the cyan vial 132', pushing the vial against breaker bar 142'. The vial 132' is crushed between the breaker bump 180 and bar 142', which ruptures the vial and releases the cyan colorant into the vehicle 105 to complete the activation step.

To lock-out the selector switch 172 to prevent other vials from being broken, and to provide a permanent indication of which vial has been selected and activated, the selection system 170 has a lock-out and indicator mechanism, here provided by one or more locking protrusions or ears 186 extending outwardly from the dial shaft 176. Preferably, the locking ears 186 are resilient in nature, allowing them to collapse against the shaft 176 as the shaft is pushed downwardly through hole 178 during the activation step. After pressing the dial 172 downwardly to break the selected vial, the locking ears 186 then rest along the interior surface of wall 149, as shown in dashed lines in FIG. 7. The ears 186 then lock the dial 172 into a lowered activated position, also shown in dashed lines in FIG. 7. Thus, the locking ears 186 provide a lock-out and indication function similar to that provided by the locking keys 164 shown in FIGS. 3 and 4 for switches 112'–118'.

In FIG. 7, the breaker bars 142'–148' are shown mounted to a support member 188, with the colorant vials 132'–138' also being supported by member 188. A similar mounting mechanism may also be employed for the colorant system 130 and breaker bar system 140 in FIG. 2. Indeed, it may be preferable to have a snap-fit structure for member 188 into which each of the vials are then pressed and secured using a snap-fit mechanism. Alternatively, the color vials may be molded, inserted, bonded or otherwise secured to the mounting member 188. The mounting member 188 may then be secured in place inside the body casing 102 to properly locate the vials for activation.

A variety of different mechanisms and devices may be used to secure the vials 132'–138' within the interior of the casing 102 and the optional liner bag 104, and such implementations are well within the capabilities of those skilled in the art. For instance, in FIG. 2 rather than having the vials 132–138 oriented vertically, they may be rotated 90 degrees into a substantially horizontal direction in the view and then secured at each end between struts to form a ladder like structure, with each of the vials positioned as rungs on a ladder. Such a ladder structure may then be wedged at a proper location within the interior of the casing 102. Indeed, such a ladder structure may also provide a suitable mounting point for the breaker bars 142–148, which may then take the form of a single vertical strut running along the backside of the ladder, preferably adjacent a midspan portion of the vial "rungs."

Third Embodiment

Figure 8:
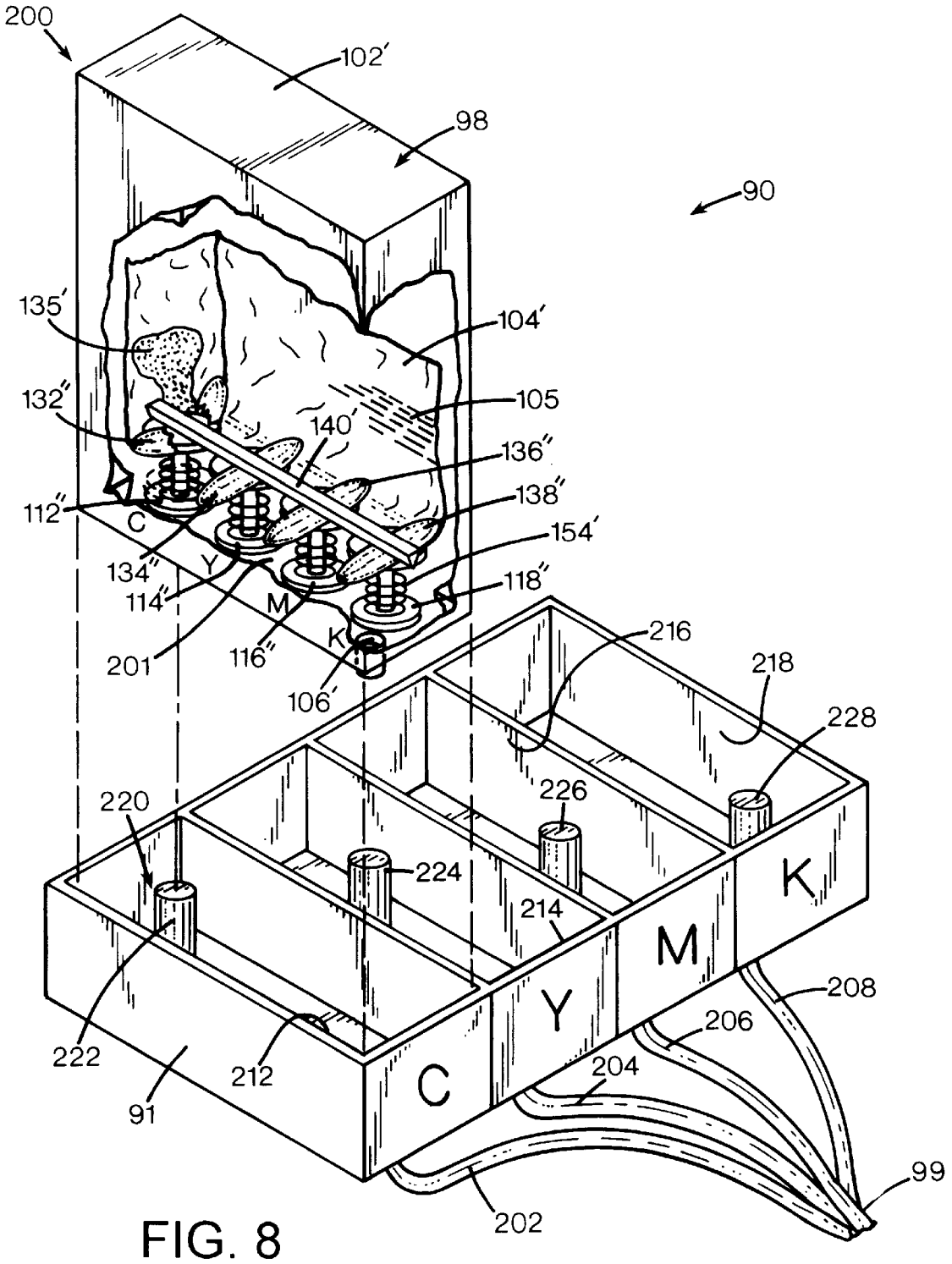
FIG. 8 is fragmented perspective view of a third embodiment of an ink replenishment system of the present invention, shown in the off-axis ink dispensing system of FIG. 1 as one of four replaceable ink supplies.

FIG. 8 shows a third embodiment of an ink replenishment system 200 constructed in accordance with the present invention, here shown for use with the off-axis ink system 90, although it is apparent that the concepts of system 200 may be applied to the carriage 55 in the replaceable cartridge system 80. Here, the system 200 includes a rigid body or casing 102', of a slightly different configuration than illustrated for body 102 in FIG. 2. Indeed, many of the components shown in system 200 may be as described for the system shown in FIGS. 2–4, and to indicate the similarity a prime (') or a double prime indicator (") is used after the item numbers to simplify this description. For example, this replenishment system 200 may include an optional liner bag 104', similar in materials and construction to liner 104, and filled with the same type of ink vehicle 105 as described above. A lower wall 201 of the casing 102' serves as a mounting location for selector buttons 112", 114", 116" and 118" for the colors cyan, yellow, magenta and black, respectively. A biasing member, such as a coil spring 154', surrounds the push rod of each selector buttons 112"–118" to bias the buttons into an inactivated state, such as when the supply 92 is new. Rather than a series of separate breaker bars 142–148, the system 200 illustrates the use of a single breaker rod 140' extending along the length of the four colorant capsules 132", 134", 136" and 138" for the colors of cyan, yellow, magenta and black, respectively.

An exit port 106' is located to extend through the casing lower wall 201. Preferably, the outlet port 106' is located adjacent an inlet portion of the ink delivery conduit 99, which separates into individual conduits 202, 204, 206 and 208 at the supply receptacle 91. Each of these ink delivery feeders 202'208 may extend into the interior portion of a series of receptor chambers defined by the receptacle 91, here, shown as a cyan chamber 212, a yellow chamber 214, a magenta chamber 216 and a black chamber 218. The chambers 212–218 each receive the respective ink supplies 92, 94, 96 and 98 illustrated in FIG. 1. As shown by dashed lines in FIG. 8, if the replenishment supply 200 is installed in the cyan chamber 212, the resulting ink composition is a cyan colored ink for supply 98 of FIG. 1.

In FIG. 8, the cyan button 112" has been pressed to select the cyan colorant which is activated by pushing the cyan vial 132" against the breaker bar 140' to break the vial open and release the cyan colorant 135' into the ink vehicle 105. The colorant selection systems of FIGS. 2–7 are manual selection systems where the selection of a particular colorant is made manually, either by depressing the push buttons in FIGS. 2–4 or by rotating the dial 172 in FIGS. 5–7. While system 200 may also be operated manually by depressing one of the selector buttons 112'–118', it may be preferable in some embodiments to have the printing mechanism 30 automatically select the desired colorant. For instance, the desired colorant may be selected by the printer 30 depending upon the location into which the replenishment cartridge 82–88 is installed in the carriage 55, or the location into which the new supply 92–98 is installed in the receptacle 91. Such an automatic selection system is illustrated for the off-axis ink delivery system 90 in FIG. 8, and it is apparent that a similar system may be incorporated into carriage 55 for use with cartridges 82–88.

In FIG. 8, the main reservoir receptacle 91 is equipped with an automatic colorant selection system 220, here comprising a series of upright selector actuators or posts 222, 224, 226 and 228 extending upwardly from a lower surface of each of the receptacle chambers 212, 214, 216 and 218, respectively. Each of the selector posts 222–228 are positioned within their respective chambers to depress the corresponding selector buttons 112"–118" when the ink replenishment supply 200 is installed in the corresponding chamber 212–218 of receptacle 91. Each of the selector buttons 112"–118" may be equipped with an indicator and lock-out mechanism 150, as shown in FIGS. 3 and 4, including the locking bar 155, or some other type of locking and indicating mechanism. The use of such a locking mechanism in the replenishment system 200 advantageously provides a permanent indication of which colorant has been selected if one of the replenishment supplies 200 is removed from receptacle 91. Such a lock-out system prevents the supply 200 after activation from being reinserted into the wrong chamber. For example, after activation of the cyan colorant 135', the illustrated supply 200 cannot be inserted into the yellow chamber 214, because the yellow selector post 224 is locked out from depressing the yellow button 114". The automatic colorant selection system 220 advantageously eliminates operator error in selecting the wrong colorant and then inserting the supply 92–98 or the replacement cartridge 82–88 into the wrong location within receptacle 91 or carriage 55.

Fourth Embodiment

Figure 9:
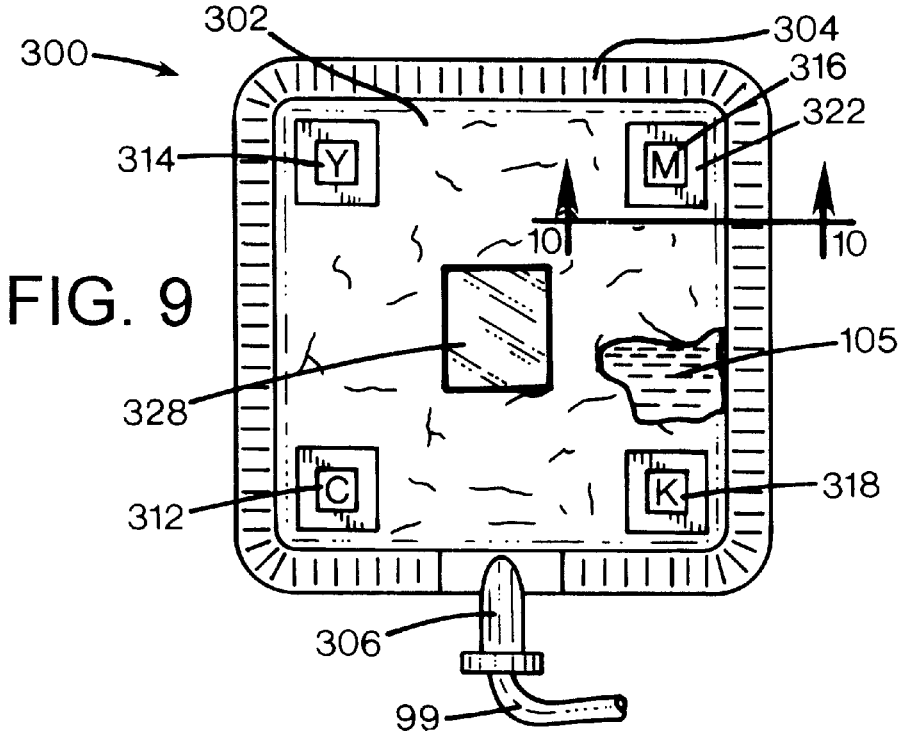
FIG. 9 is a side elevational view of a fourth embodiment of an ink replenishment system of the present invention.
Figure 10:
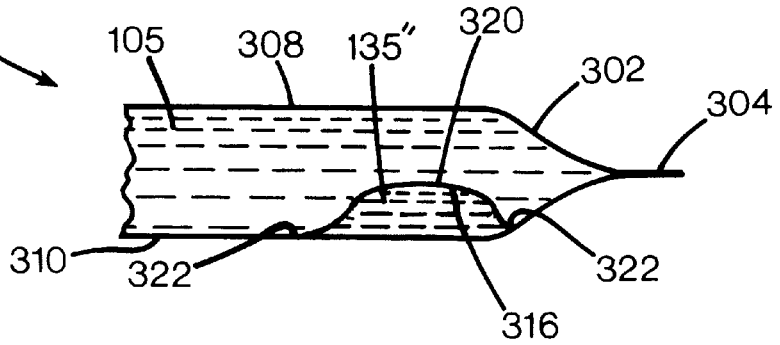
FIGS. 10 and 11 are enlarged bottom sectional views taken along lines 10—10 of FIG. 9, with FIG. 10 showing a new, unmixed state, and FIG. 11 showing the selection and mixing steps.
Figure 11:
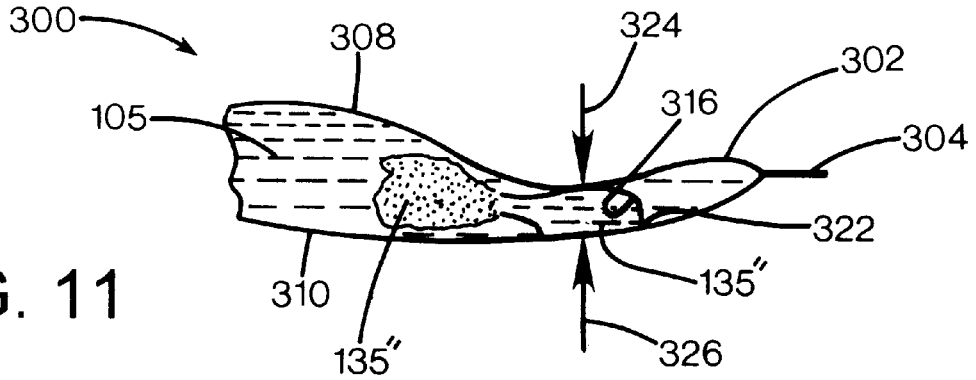

FIGS. 9–11 illustrate a fourth embodiment of an ink replenishment system 300 constructed in accordance with the present invention. Here, the ink replenishment system 300 comprises a flexible pouch or bag 302, preferably of a plastic or foil or other substantially moisture impervious material. The pouch 302 may be formed from two sheets of this moisture impervious material, which are adhered, bonded or otherwise joined along their outer edges or border regions 304, for instance through a heat sealing process. An ink outlet port 306 is provided, for example along a portion of border 304, to extract the mixed printing composition through a portion of the ink delivery tubing system 99. The interior of the pouch 302 is filled with the ink vehicle 105 as described above. While the pouch 302 is shown for use in the off-axis system 90, it is apparent that pouch 302 may be suitably modified to fit into the body of a replaceable cartridge for use in the on-axis ink delivery system 80.

In the illustrated embodiment, the pouch 302 has two opposing flexible walls 308 and 310, as shown in FIGS. 10 and 11. A series of colorant storage chambers, such as four chambers 312, 314, 316 and 318 are defined within the interior of the pouch 302, for example, by heat sealing or otherwise bonding a third layer 320 to an interior portion of the pouch 302, here shown as being bonded to the interior portion of wall 310. The material for the third layer 320 may be a type of blister material, which is easily pierced or ruptured under pressure. The region between the blister layer 320 and the exterior wall 310 defines the colorant chambers 312–318, which are each bounded by a border portion, such as border region 322 shown for the magenta chamber 316. The chambers 312, 314, 316, and 318 contain the respective colorants for cyan, yellow, magenta and black, as indicated by the letters C, Y, M, K on the exterior surface of wall 308 in FIG. 9. As mentioned above with respect to the embodiments of FIGS. 2–8, rather than using the letter nomenclature, colored patches corresponding to each of these colors may be placed on the exterior surface of the pouch 302 in a location substantially over the colorant chambers 312–318.

Selection of which colorant to activate may be done manually by a user pinching each side of the bag 302 to place excessive pressure on the selected chamber, for instance, on the magenta chamber 316 as indicated by arrows 324 and 326 in FIG. 11. Preferably, the internal blister layer 320 is selected to be of a material with a lower puncture or breaking strength than the exterior walls 308, 310, so under the force of this pinching action, the wall 320 of chamber 316 is ruptured, allowing the magenta colorant 135" to escape and be introduced into the vehicle 105. Mixing of the colorant 135" with the ink vehicle 105 may be accomplished through dispersion, by merely letting the activated pouch 302 sit for a given period of time prior to use. Alternatively, mixing may be accomplished by manually shaking the activated pouch 302, by an action of kneading the pouch, or by a combination of both actions. Indication of which colorant has been selected may be provided, for instance, by inserting a clear window portion 328 through the pouch wall 308, so a user may visually monitor which color has been selected by peering into the interior of the pouch 302.

Fifth Embodiment

Figure 12:
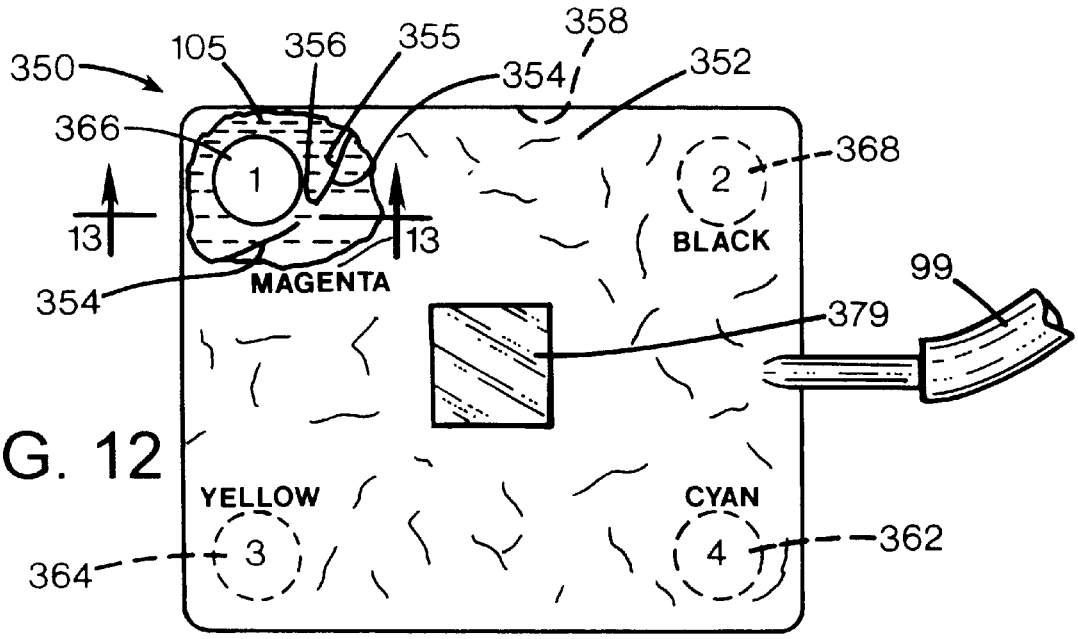
FIG. 12 is a fragmented, side elevational view of a fifth embodiment of an ink replenishment system of the present invention.
Figure 13:
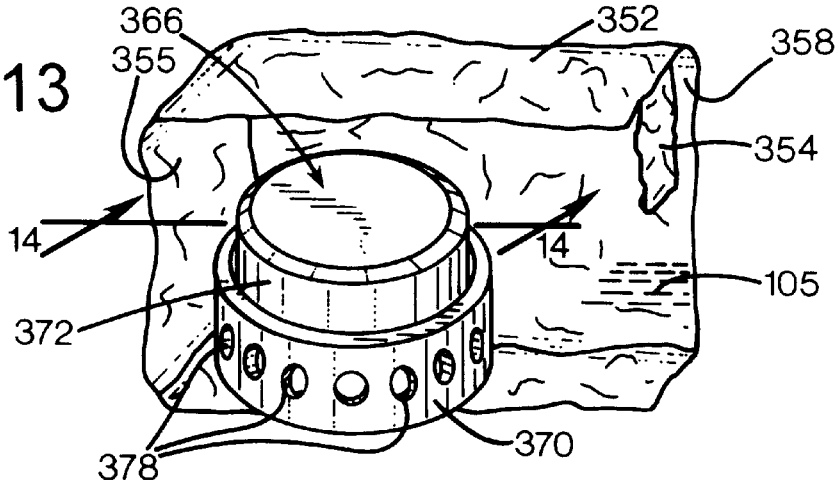
FIG. 13 is an enlarged perspective view taken along lines 13—13 of FIG. 12.
Figure 14:
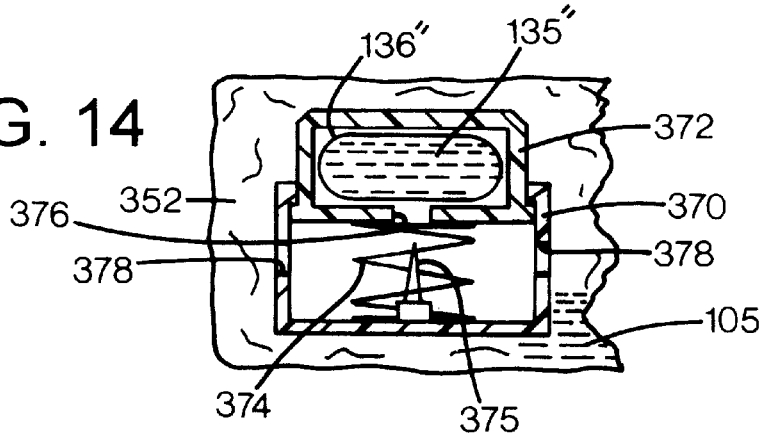
FIG. 14 is a sectional view taken along lines 14—14 of FIG. 13.

FIGS. 12–14 illustrate a fifth embodiment of an ink replenishment system 350 constructed in accordance with the present invention. The replenishment system 350 has a flexible bag or pouch 352, which may be of the same materials described above for pouch 302. Preferably, along four different regions within the interior of bag 352, such as in the four corners, are located four sets of isolation walls, such as walls 354, that define four colorant retaining chambers, such as subchamber 355. Each set of walls 354 defines a passageway 356 therethrough so each subchamber 355 is in fluid communication with a main interior chamber 358 defined by bag 352. The passageways 356 allow the ink vehicle 105 within the main chamber 358 to also permeate each of the subchambers 355.

Within the interior of each subchamber 355, preferably a colorant retention and activation assembly is located, such as activation assemblies or buttons 362, 364, 364 and 368 for the respective colors of cyan, yellow, magenta and black. The outer surface of the bag 352 may be marked with words or letters indicating the colors within each assembly 362–368, or more preferably, the outer surface of the bag 352 may carry patches of each color in a location approximately over each of these activation buttons. The walls 354 aid in retaining the activation assemblies 362–368 in an area under these color indicia labels.

FIGS. 13 and 14 show the activation button 366 in greater detail as including a lower base or retainer portion 370, which receives and retains an upper colorant containing button portion 372. The button 372 is sized to hold a breakable, rupturable or puncturable colorant container, which may be of a plastic, foil or a glass for instance, here illustrated as a glass vial 136". The button 372 is biased away from retainer 370 by a biasing member, such as a coil spring 374. Extending upwardly from the lower surface of the retainer 370 is a rupturing member similar to the breaker bars 142–148, but here taking the form of a puncturing spike 375. The lower wall of the colorant retaining button 372 defines a spike receiving hole 376 therethrough.

When the button 372 and the retainer 370 are pushed together, the spike 375 slides through hole 376 and rams into the vial 136" to puncture, rupture or pierce the vial to activate the selected colorant, here, magenta 135". After the spike 375 breaches the ink container 136", the released colorant 135" flows through the spike inlet hole 376 and into the interior of retainer 370. Preferably, the retainer 370 defines one or more fluid passageways, such as a group of holes 378, which allow the colorant to escape from the interior of the retainer 370. After leaving the retainer 370, the colorant 135" permeates through retaining chamber 355, then flows through the passageway 356 and into the main chamber 358. Since prior to activation, the vehicle 105 fills the interior of the retainer 370, the dispersion of colorant 135" is expedited by this presence of the vehicle 105. It is apparent that the colorant 135" may also be introduced into the vehicle 105 through fluid passageways, for instance similar to holes 378, formed through the button 372.

Sixth Embodiment

Figure 15:
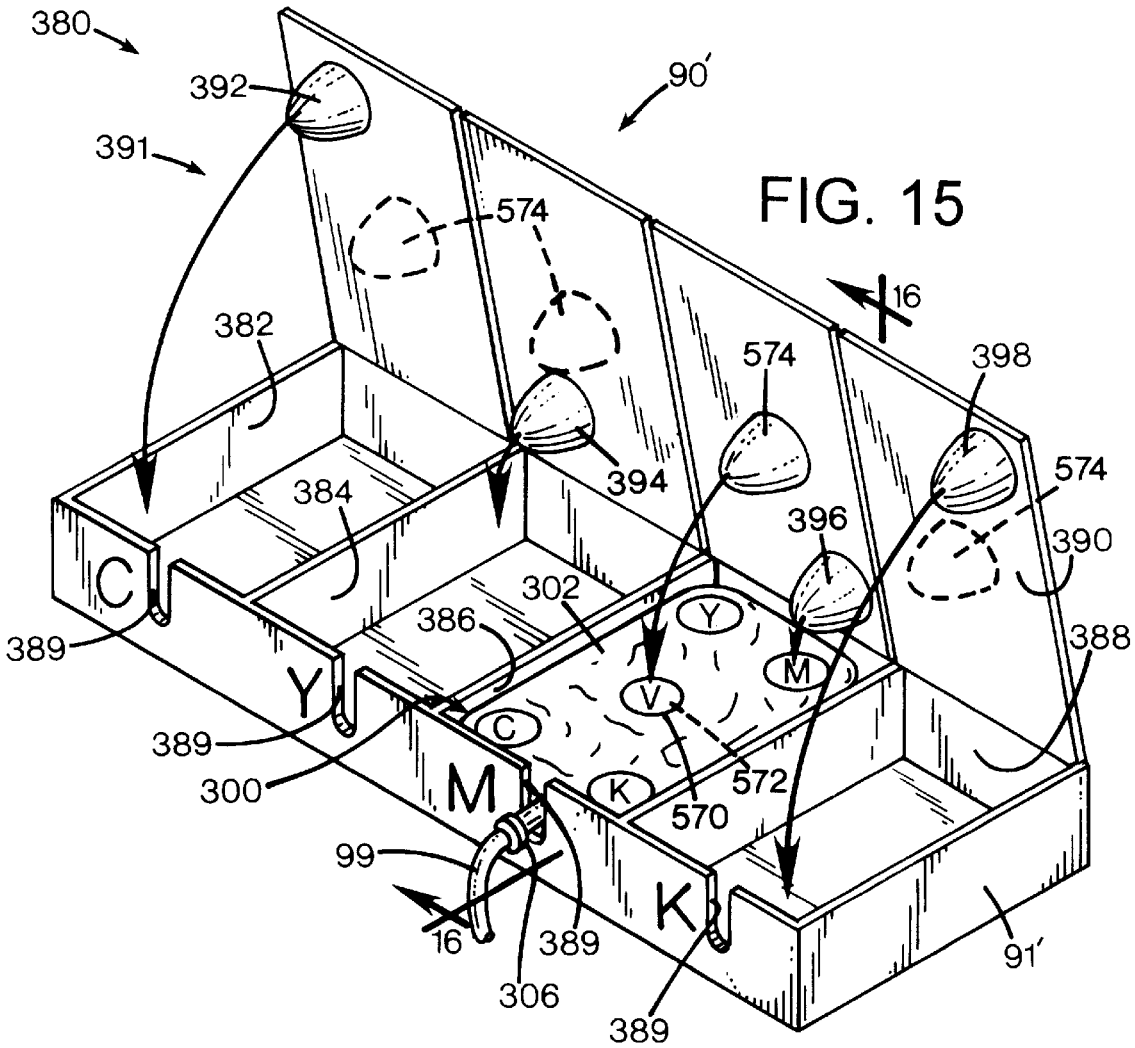
FIG. 15 is a perspective view of a sixth embodiment of an ink replenishment of the present invention, which may be used in conjunction with either the fourth embodiment of FIGS. 9–11, or the fifth embodiment of FIGS. 12–14, particularly in an off-axis ink dispensing system in the printing mechanism of FIG. 1.

FIG. 15 illustrates a sixth embodiment of an ink replenishment system 380 constructed in accordance with the present invention, here for use as an alternate off-axis dispensing system 90' to that illustrated in FIGS. 1 and 8. The ink replenishment system 380 may be used in conjunction with either the flexible bag replenishment system 300 of FIGS. 9–11, or with the flexible bag system 350 of FIGS. 12–14, which has the colorant stored in buttons 362–368. In the illustrated embodiment, the replenishment system 300 is shown with pouch 302 located to activate the magenta colorant 135", which corresponds to the embodiment illustrated in FIGS. 9–11. Here, in this alternate off-axis system 90', the main ink reservoir receptacle 91' has a base constructed to define four chambers 382, 384, 386 and 388 for dispensing the colors of cyan, yellow, magenta and black, respectively, as illustrated for pouch 302 within the magenta chamber 386. Each of the chambers 382–388 preferably has an outlet slot 389 which receives a neck portion of the ink outlet 306 from each pouch 302. The ink delivery tubing 99 is coupled to the outlet 306 to deliver the resulting ink magenta composition to the magenta mini-reservoir 84' and printhead 74.

Figure 16:
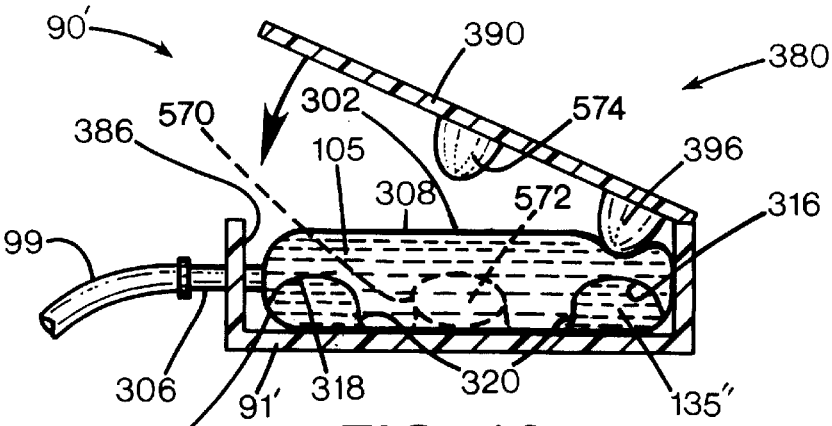
FIG. 16 is a sectional side elevational view taken along lines 16—16 of FIG. 15, showing the ink replenishment system of FIGS. 9–11 installed therein.

The replenishment system 380 illustrates an automatic selection and activation system which may be used instead of the manual activation systems described above with respect to FIGS. 9–14. Here, the ink receptacle 91' includes a hinged lid 390 which is pivoted to the receptacle base adjacent to the chambers 382–388 to fold down upon and enclose these chambers. Along the interior surface of lid 390 is a colorant selection system 391, here comprising four activation or puncturing protuberances, such as four colorant activators or bursting bumps 392, 394, 396 and 398. The bursting bumps 392–398 activate the respective colorants cyan, yellow, magenta and black when ink bags 302 are installed within chambers 382–388. For instance, FIG. 16 shows lid 390 closing upon the magenta chamber 386, with the magenta bursting bump 396 beginning to compress bag 302 in the activation process of squeezing the magenta chamber 316 to eject the magenta colorant 135 into the vehicle 105. Thus, the protuberance 396 and the bottom surface of chamber 386 come together while lid 390 is closing to provide the pinching forces 324, 326 illustrated in FIG. 11 which cause chamber 316 to burst and free the colorant 135".

Seventh Embodiment

Figure 17:
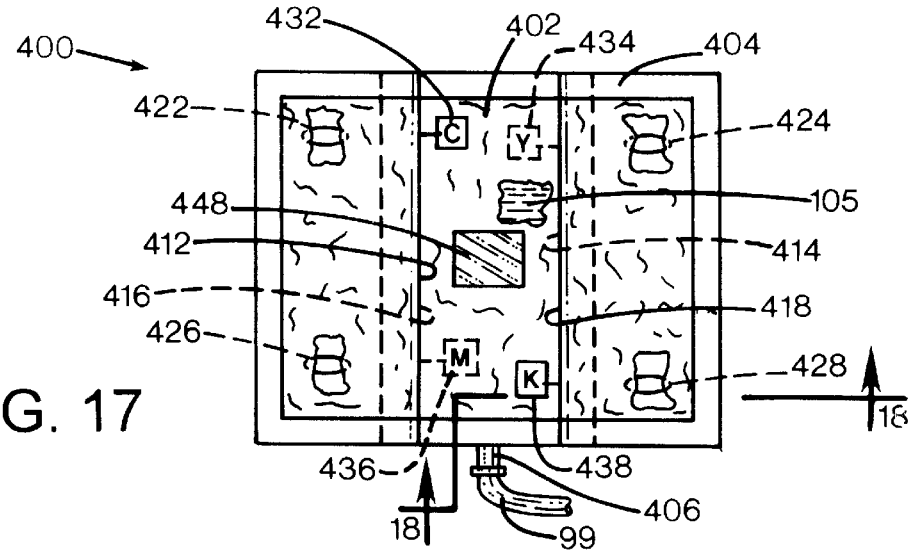
FIG. 17 is a side elevational view of a seventh embodiment of an ink replenishment system of the present invention.
Figure 18:
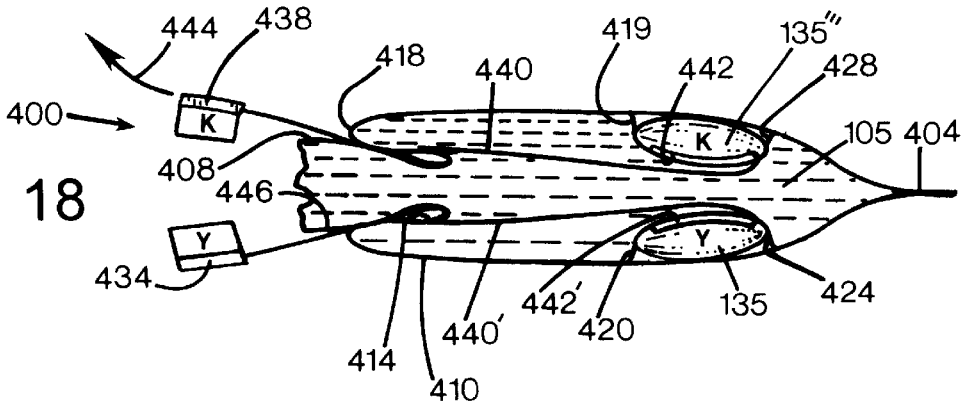
FIGS. 18 and 19 are sectional bottom views taken along lines 18—18 of FIG. 17, with FIG. 18 showing a new or inactivated state, and FIG. 19 showing the selection and mixing steps.
Figure 19:
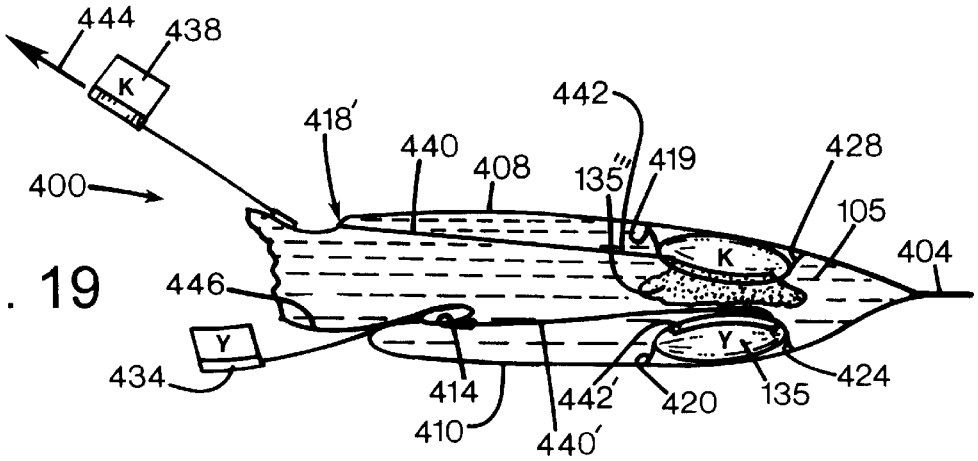

FIGS. 17–19 illustrate a seventh embodiment of an ink replenishment system 400 constructed in accordance with the present invention. While the ink replenishment systems of FIGS. 2–16 have dealt with activation of a liquid colorant, in the replenishment system 400, the colorant is supplied in a solid form such as a pellet or pill, which is isolated from the liquid ink vehicle 105 until activation. Indeed, rather than a single solid pellet or pill for each colorant, the colorant may also be supplied in a granular, powdered or pelletized dried form, which may be also be substituted for the liquid colorants illustrated in FIGS. 2–16. Upon exposure to the vehicle 105, the colorant particles dissolve and disperse throughout the vehicle 105.

The replenishment system 400 includes a flexible pouch or bag 402 which may be constructed of the same materials as described above for the flexible bag 302. The bag 402 may have a border portion 404 which may also be formed and sealed as described above for border 304. Preferably, the system 400 includes an outlet member 406 which couples the interior of bag 402 to the ink delivery conduit 99. The interior reservoir of bag 402 is filled with the ink vehicle 105. The pouch 402 has an upper layer 408 and a lower layer 410, which here are preferably joined through a heat sealing process along border 404. The upper and lower layers 408 and 410 form walls which define the main ink reservoir in the off-axis assembly 90.

Preferably, each of the upper and lower layers 408 and 410 have two folds formed therein, which may be secured in place through the use of a heat sealing process along border 404. These folds are useful in implementing a tear strip or pull cord activation system described further below. For instance in the view of FIG. 17, the upper layer 408 has a fold 412 to the left, the lower layer 410 has a fold 414 to the right, while to the left layer 410 has a fold 416, and returning to the upper layer 408, a fold 418 appears to the right. Located along the interior surface of a portion of the upper layer 408 is a layer 419 tearable or rippable material, and a similar layer 420 of a tearable material is located along the interior surface of the lower layer 410. The layers 419 and 420 are adhered, bonded or otherwise attached to the respective layers 408 and 410 to define four colorant containing chambers 422, 424, 426 and 428 which preferably contain a solid color pellet or granular form of colorants for cyan, yellow, magenta and black, respectively.

A selection tag and pull cord are attached to an interior surface of each of the folds, specifically, with cyan, yellow, magenta and black indicator tags and pull cords 432, 434, 436, and 438 being secured to an internal portion of the respective folds 412, 414, 416 and 418. Specifically, the pull cords 432 and 438 are attached to he exterior surface of wall 408, whereas the pull cords 434 and 436 are attached to the exterior surface of wall 410. Adjacent these attachment points for the pull cords 432–438, along the interior surface of walls 408 and 410 are attached tether cords, such as tether cord 440 shown in FIGS. 18 and 19. The tether cord 440 is attached to a tear strip or pull strip portion 442 formed within the liner wall 419 which forms the chamber 428 for receiving the black colorant 135'''. In the views of FIGS. 18 and 19, a tether cord 440' is joined to the interior surface of wall 410 adjacent the attachment point for the yellow pull cord 434. The other end of the tether cord 440' is attached to a pull strip 442' for opening the yellow colorant chamber 424. The cyan and magenta chambers 422, 426 are similarly equipped with tether cords and pull strips.

FIGS. 18 and 19 illustrate the steps of selection and activation of the black colorant constituent 135'''. As shown by arrow 444, the black indicator tag and pull cord assembly 438 has been pulled away from the bag 402 to unfurl the fold 418. Removing the fold 418, as indicated at item 418' in FIG. 19, operates to pull the tether cord 440 taut, which in turn tears the pull strip portion 442 away from the chamber wall 419, rupturing or tearing open chamber 428. Once open, the ink vehicle 105 permeates into chamber 428 to begin to dissolve or melt the solid colorant pellet or pill contained therein. Alternatively, if the colorant is a granular material, then opening of the colorant chamber 428 allows this granular colorant to spill into a main reservoir portion 446 of ink bag 402. After activation, the extended nature of the selector tag and pull cord 438 provides a visual indication as to which colorant has been activated within the pouch 402. As an alternative indicator, or for a visual check, a transparent window 448 may be supplied through a central portion of wall 408, for instance as shown in FIG. 17.

Eighth Embodiment

Figure 20:
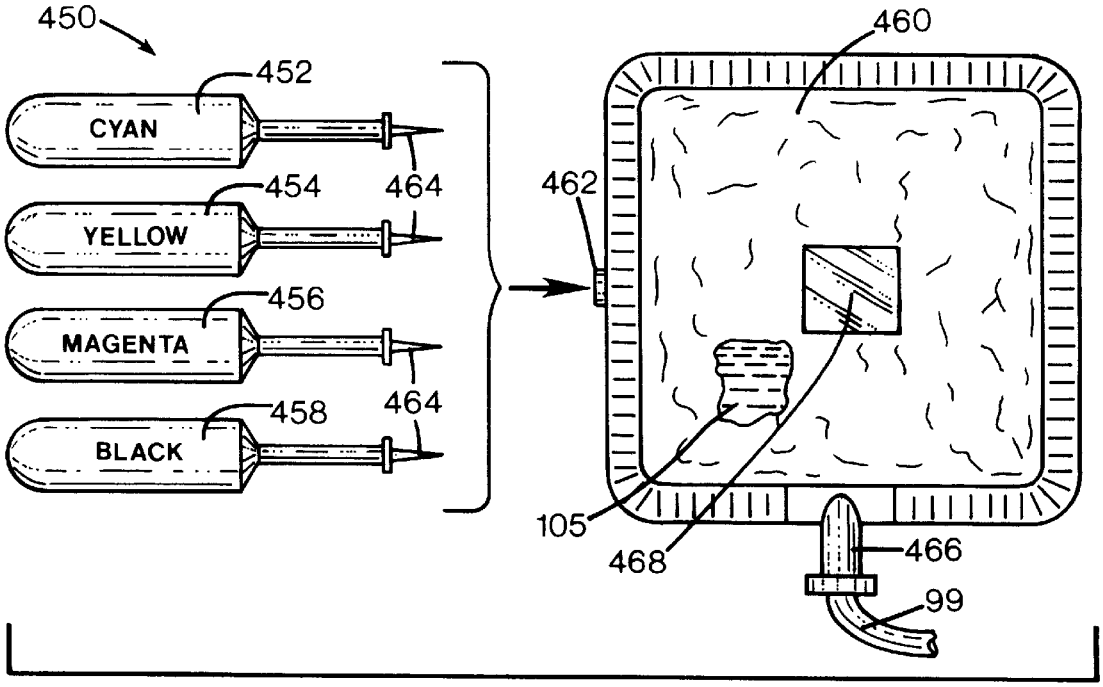
FIG. 20 is a side elevational view of an eighth embodiment of an ink replenishment system of the present invention, here shown comprising a colorant selection kit.

FIG. 20 illustrates another manual ink replenishment system 450 constructed in accordance with the present invention, as comprising a kit with four separate containers, such as syringes of colorant 452, 454, 456 and 458 being supplied along with a vehicle-holding reservoir container, such as a flexible pouch or bag 460. The flexible bag 460 may be of the same materials and construction as described above for the pouch 302, but constructed without the ink containing chambers 314–318. Instead, the pouch 460 includes an ink inlet 462, through which an outlet portion 464 of one of the syringes 452–458 may be inserted to introduce a selected colorant into the vehicle 105. Once injected with colorant for activation, the pouch 460 may be shaken or kneaded to speed the process of mixing the colorant with the vehicle 105. The pouch 460 also has an outlet 466 to which is coupled the ink delivery tubing 99.

To provide an indication of which of the particular colorants 452–458 have been injected into the bag 460, the exterior surface may be provided with a transparent window 468 for visual inspection to determine the color of the resulting ink composition. Indeed, ink replenishment system 450 may be supplied as a kit with several vehicle-containing bags 460. This system 450 allows stores and consumers to stock a single ink replenishment item while leaving selection and mixing of the desired colorant until the time of use.

Ninth Embodiment

FIGS. 21 and 22 illustrate a ninth embodiment of an ink replenishment system 470 constructed in accordance with the present invention, here, selecting between a standard cyan, yellow and magenta colorant scheme or an alternate colorant scheme, such as a photo imaging system using reduced dye-load concentrations of cyan, magenta and black, in a three chamber replaceable inkjet cartridge 472. The tri-chamber cartridge 472 has a rotating selector switch or dial 474 mounted to the cartridge exterior. The rotating switch 474 may be constructed as described above for the selector switch 172 of FIGS. 5–7.

The exterior of the cartridge 472 bears indicia 476 to aid in selection of the first set of colorants, here, cyan, magenta and yellow, as indicated by the letters C, Y, M, or alternatively, by using patches of these colors. The second selection of photo-imaging colorants is indicated by the use of the word "photo" as indicia 478 along the exterior of the cartridge 472. Rather than using words, a picture perhaps of a portrait or scenery may be used as a substitute for indicia 478. The dial switch 474 may be equipped with indicia, such as arrow 480, to provide an indication as to which of the two sets of colorants has been selected. In FIGS. 21 and 22, the pointer 480 indicates a selection of cyan, yellow and magenta.

FIG. 22 shows the cartridge 472 as defining three ink chambers or reservoirs 481, 482 and 483, each filled with vehicle 105. The selector switch 474 includes an internal activation disk 484, which is coupled by a shaft 485 to the exterior dial portion of switch 474, upon which the indicator arrow 480 appears. The shaft 485 may be constructed as described above for shaft 176 in FIG. 7, including the locking ears 186, and with the cartridge 472 also formed with a recess similar to recess 175 to provide a permanent record of which group of colorants has been activated. For the CYM selection, breakable vials 486, 487 and 488 containing cyan, yellow, and magenta colorants are secured within each of the chambers 481, 482 and 483. The interior surface of the activation disk 484 adjacent the vials 486–488 has three protruding activation members or breaker bumps 491, 492 and 493 which are shown in position ready to break vials 486, 487 and 488, respectively, when the switch 474 is depressed.

Each of the chambers 481, 482 and 483 is also supplied with breakable vials 494, 495 and 496 containing imaging colorants, such as reduced dye-loads of cyan and magenta colorants, and a reduced or a full dye-load of black colorant. As described above with respect to FIGS. 2–7, a breaker bar or other rupturing assistant member, such as breaker bars 498, may be provided beside each of the vials 486, 487, 488, 494, 495 and 496. When the selector switch 474 is rotated so the indicator arrow 480 is pointing downward toward the "photo" selector indicia 478 for the imaging colors, the breaker bumps 491, 492 and 493 are then positioned as indicated in dashed lines 491', 492' and 493', over the respective imaging colorant containers 496, 495 and 494, ready for activation.

Figure 23:
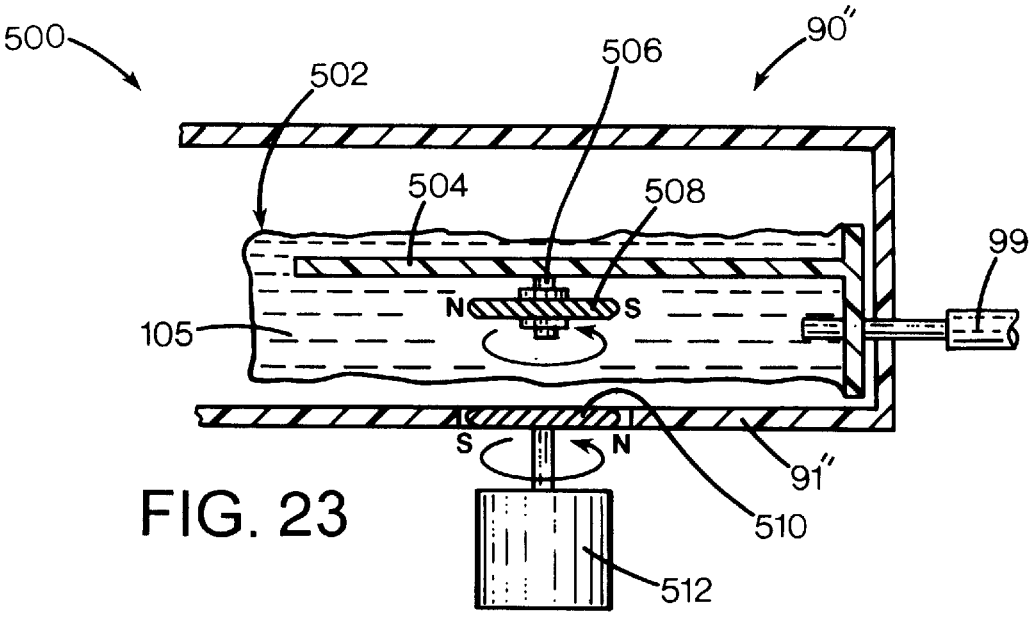
FIG. 23 is a sectional top plan view of a tenth embodiment of an ink replenishment and dispensing system of the present invention, here, showing one manner of mixing using a magnetic mixing system.
Figure 24:
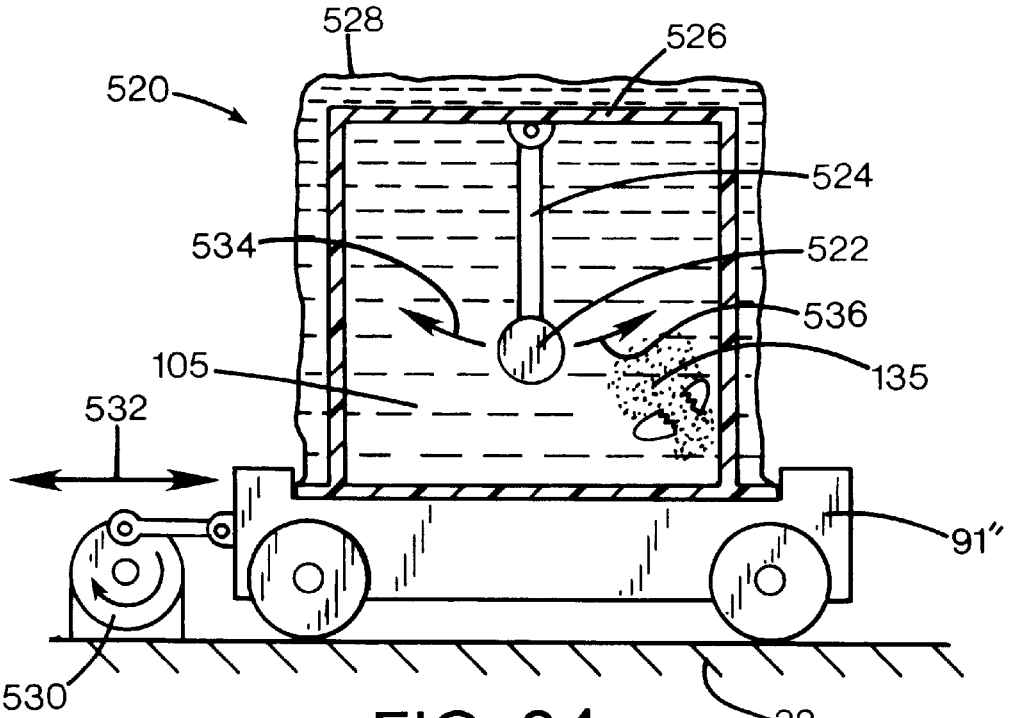
FIG. 24 is a partially sectional side elevational view of an eleventh embodiment of an ink replenishment and dispensing system of the present invention, here using a mechanical internal mixing member in conjunction with external mechanical agitation.
Figure 25:
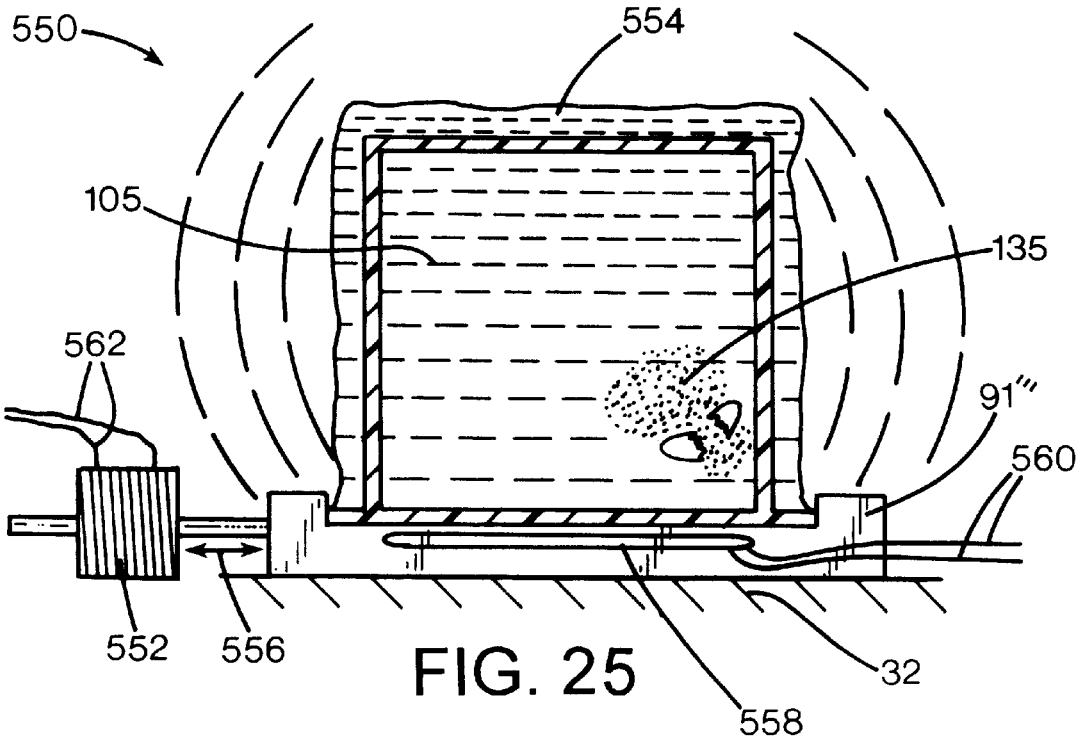
FIG. 25 is a partially sectional side elevational view of a twelfth embodiment of an ink replenishment system of the present invention, showing mixing using a vibrational scheme.

The first nine embodiments of ink replenishment systems described with respect to FIGS. 2–22, have dealt primarily with different means of selecting a desired colorant and then activating this colorant. Another step in this method of mixing the ink printing composition at the time of use requires mixing of the colorant with the vehicle 105, which may also include the mixing of the volatile components of the printing composition, if they are not supplied in a pre-blended form along with the vehicle 105. FIGS. 23–25 illustrate the tenth embodiment, eleventh and twelfth embodiments of an ink replenishment system of the present invention as including various ways of mechanically mixing the activated colorant with the vehicle 105. The embodiments of FIGS. 23–25 advantageously require no user intervention other than installing the ink replenishment container, either in the carriage 55 for an on-axis system, or in the main reservoir receptacle 91, 91' for an off-axis system.

Tenth Embodiment

FIG. 23 illustrates a tenth embodiment of an ink replenishment delivery system comprising a magnetic mixing system 500 constructed in accordance with the present invention. This ink replenishment system may be used in combination with any of the embodiments illustrated in FIGS. 2–22, for selecting and adding ink to the vehicle 105. The magnetic mixing system 500 is illustrated for use with an off-axis ink delivery system 90", which includes a receptacle 91" which may include four chambers, for instance as described above with respect to FIGS. 1, 8 and 15–16. Here, a vehicle retaining casing or liner 502, which may take the forms of any of the embodiments illustrated above with respect to FIGS. 2–22, is equipped with an internal support member 504 which extends into the vehicle 105. An axle shaft 506 extends from the support 504. The axle 506 supports a rotating magnet member 508 which has opposing north (N) and south (S) magnetic poles.

The rotating magnetic 508 serves as a stirring wand, which rotates in response to rotation of an external magnetic member 510, also having north and south poles. The external magnetic 510 is driven by a motor 512. Since opposite magnetic poles attract and like magnetic poles repel, through the forces provided by magnetic flux, rotation of the external magnet 510 induces rotation of the internal magnetic wand 508, which serves to hasten the mixing and disbursement of the colorant within vehicle 105. Indeed, the single motor 512 may be used to rotate matching pairs of activation and mixing members 510, 508 for each of the ink containing chambers, such as the off-axis main chambers 192–198 in FIG. 1, or within the replaceable cartridges 82–88.

Eleventh Embodiment

FIG. 24 illustrates an eleventh embodiment of an ink replenishment system 520 employing an internal mechanical mixing member, such as pendulum 522. The pendulum 522 is suspended from a shaft 524 which is pivoted to a support member 526 inside a container 528 holding the vehicle 105. The ink container 528 may be constructed as described above for any of the containers of FIGS. 2–20. The ink container 528 may be installed within a receptacle 91" which is mounted for a sliding or translational motion with respect to chassis 32. The receptacle 91" may be moved back and forth, for instance using a motor-driven, eccentrically-mounted link assembly 530, or other activation means to induce this back and forth motion as indicated by arrow 532. This back and forth motion 532 of the receptacle 91" induces a swinging motion in the pendulum 522, as indicated by the curved arrows 534 and 536. This back and forth swinging motion of the pendulum 522 speeds the mixing of a released colorant with the vehicle 105.

In an alternate embodiment, such a pendulum may be installed in the replaceable inkjet cartridges 82–88, and this mixing may then be induced through moving the printhead carriage 55 back and forth along the scanning axis 56. Or alternatively, without the use of such a pendulum, a mechanical shaking action may be induced within the cartridges 82–88, by rapidly reciprocating the carriage 55 back and forth along the scanning axis 56.

Twelfth Embodiment

FIG. 25 illustrates a twelfth embodiment of a vibratory mixing ink replenishment system 550, constructed in accordance with the present invention. This vibrational system is particularly useful for the off-axis delivery system 90 where an ink receptacle 91'" is mounted for sliding motion with respect to the chassis 32, for instance, as provided through the use of a vibratory motor 552. Here, an ink replenishment bag or member 554, which may be constructed as described above for any of the embodiments of FIGS. 2–20, is installed in receptacle 91. The mixing operation is enhanced by vibrating the receptacle 91'", with this vibratory motion being indicated by the curved dashed lines in FIG. 25 and by the double-headed arrow 556.

Other mechanisms may also be used to induce and speed the mixing process. For instance, if heating of the ink vehicle 105 speeds the mixing process, the ink receptacle 91''' and/or carriage 55 may be equipped with an optional heating element, such as heating element 558 illustrated in FIG. 25. In the view of FIG. 25, items 560 indicate electrical conductors coupling the heater element 558 to a power source, whereas conductors 562 illustrate electrical conductors coupling the vibratory unit 552 to a power supply, such as a power supply located adjacent the controller 50 in FIG. 1.

Replenishment Method of Blending Ink Constituents at the Time of Use

A method of formulating a desired ink composition at the time of use is also illustrated with respect to the embodiments of FIGS. 2–25. This method includes the steps of selecting the colorant, which may or may not include volatile materials, and/or selecting a container of volatile materials (item 570 in FIGS. 15–16), which is then opened to activate the colorant and/or volatile materials by introduction into the colorless vehicle 105. Moreover, the types of colorants used may be liquid, pelletized, tablets or granular solid constituents, which are then dissolved upon introduction into the vehicle 105.

Prior to activation, the ink constituents are isolated from the ink vehicle using a variety of different introduction mechanisms. For example, the embodiments of FIGS. 2–8, 12–14 and 21–22 employ ink constituents contained within a breakable or rupturable container, such as a glass vial. The use of a tearable or rippable chamber is illustrated by the embodiment of FIGS. 17–19. An external introduction mechanism for isolating and inserting of colorant and/or volatiles into the vehicle 105 using a replenishment system supplied as a kit 450 is illustrated in FIG. 20. The embodiment of FIGS. 9–11 and 15–16 illustrate the use of ink constituents contained within a rupturable blister or chamber which is deformed and broken through the application of pressure, either manually with respect to FIGS. 9–11 or automatically through the use of a portion of the inkjet printing mechanism, such as the ink receptacle 91' in FIGS. 15–16.

Another automatic selection and activation technique is illustrated with respect to the receptacle rupturing posts 222–228 shown in FIG. 8. A manual selection and activation process was accomplished through pushing buttons in the embodiments of FIGS. 2–8, by rotating a selector switch in the embodiments of FIGS. 5–7 and 21–22, and through squeezing an indicated portion of the container in the embodiments of FIGS. 9–14, with this selection and activation occurring manually. A tear strip selection and activation process is illustrated in FIGS. 17–19, where one of the indicator tabs 332–338 is pulled to tear open the desired colorant chamber 422–428. Selection and activation of the proper colorant in the system of FIG. 20 involves inserting the desired colorant containing syringe 252–258 into the inlet port 462, and then squeezing the syringe to inject the desired colorant into vehicle 105.

Indeed, following on the heels of the selecting step, comes the step of activation which entails breaking vials in FIGS. 2–8, 12–14 and 21–22, rupturing chambers in FIGS. 9–11 and 15–16, tearing or ripping in FIGS. 17–19, and injection in FIG. 20. All of these actions are just illustrative of the many ways in which the colorant and/or volatiles may be introduced into the ink vehicle. There are a variety of other manners within the abilities of those skilled in the art to bring the colorant and/or volatiles into contact with the vehicle 105, which may then be followed by a mixing step.

After selection and activation, it would be desirable to know which of the particular colorants has been selected, and if possible to provide some sort of a lock-out mechanism to prevent any of the other colorants from being selected later, which would then muddy and contaminate the desired, first selected printing composition. For example, two different lock-out and indication schemes are illustrated with respect to FIGS. 3–27. The flexible bag embodiments of FIGS. 9–20, may each include transparent windows, such as windows 328, 379, 448 and 468 may be used as indicators of which colorant has been selected through visual inspection.

Following selection and activation, a mixing step is required to disperse the selected colorant and/or volatiles throughout the vehicle 105 in an even fashion to provide a uniform ink printing composition. This mixing may be accomplished by mere diffusion or dispersion, with or without additional agitation, to dissolve the colorant so it can infiltrate, permeate and saturate the vehicle 105. Besides letting the activated solution just sit so the colorant mixes by dispersion over time throughout the vehicle 105, manual mixing may be accomplished by shaking the container, or by massaging or kneading the flexible bags of FIGS. 9–14 and 16–20. Several ways of providing an automatic mixing mechanism are described with respect to the embodiments of FIGS. 23–25, including the mechanical mixing act of merely moving the printhead carriage 55 back and forth along the scanning axis 56. The manners of applying this mixing motion may be through use of an internal mixing member, such as shown in FIGS. 23 and 24, using magnetic induction mixing wand 508 in FIG. 23 and the swinging pendulum 522 in FIG. 24. This mixing may occur through the use of mechanical motion as shown in FIGS. 24 and 25 for moving or vibrating the off-axis system 90.

CONCLUSION

Thus, a variety of different advantages are realized using the various embodiments of an ink replenishment system described above with respect to FIGS. 2–25. For example, pre-mature ink aging is avoided by containing the volatile components within a volatile-impervious container (item 570 in FIGS. 15–16) until the time of use, so the shelf-life of an ink composition may be significantly extended over that of the earlier factory-blended ink compounds. Another significant advantage is the ability for the user to select which colorant to mix with the ink vehicle and volatiles at the time of use. Thus, for a particular model of printer, only a single ink container may be stocked by stores and purchased by consumers, which alleviates consumer frustration at going all the way to the store to purchase a particular color, only to find that the store has every color but the one desired. This system allows both the stores and consumers to devote less storage space and resources to stocking a variety of different colors. Furthermore, custom-blended colors are advantageously provided in an economical fashion for business, industry and the like, who repeatedly use a particular hue or shade of color, such as for trademark use.

While the illustrated embodiments contemplate some sort of bag, bladder or container for holding the ink vehicle and containers of colorant (and/or volatiles) to be selected, it may also be possible to implement such a selection system in a foam-based pen system. A foam-based inkjet cartridge fills the ink reservoir with an open-cell sponge-like foam material which acts as a back-pressure device to prevent ink from leaking out of the printhead nozzles. These principles discussed above may be implemented in a foam-based system, assuming adequate mixing of the ink constituents may be accomplished throughout the foam structure, such as through diffusion or dispersion, for instance by selecting the colorant and then letting the foam-filled container sit overnight before printing.

Furthermore, while colorants, volatiles and printing constituents have been described as being mixed within the various replenishment systems of FIGS. 2–25, it is apparent that other solutions may also be mixed and introduced into the inkjet printing mechanism 30 using these principles. For example, rather than a printing composition, the ink composition may be a cleansing solution mixed within these containers at the time of use, for instance an ink solvent composition to clean the printheads 72–78, or to clear blockages within the ink delivery tubing 99. The cleaning solution may also be dispensed to clean other components in the printer, such as to clean the printhead caps or wipers in the service station area 58, or to dissolve ink residue accumulated in the service station spittoon.

In some embodiments it may be preferred to add a fifth capsule or container containing the volatile components, which are then also selected and released into the vehicle 105, along with the desired colorant. For example, FIGS. 15 and 16 illustrate this concept of an additional volatile-containing chamber 570 defined within the interior of the pouch 302 in the same manner as described for the four colorant chambers 312–318. To activate a volatile ("V") material 572 contained within chamber 570, the portion of hinged lid 390 of ink receptacle 91' that covers each chambers 382–388 may include a volatile-activating puncturing protuberance or bursting bump, such as bump 574 adjacent chamber 386. The locations for the bursting bumps 574 adjacent chambers 382, 384 and 388 are shown in dashed lines for simplicity. It is apparent that the embodiments of FIGS. 2–14 and 17–22 may be modified to include an additional volatile-containing chamber or vial, along with an associated additional activation device. Indeed, it may be preferred in some embodiments to select, activate and mix the volatile components first, followed by selection, activation and mixing of a desired colorant, or the procedure could be reversed in other implementations, depending on the types of constituents selected. For instance, if release of the volatiles 572 before the colorant was desired, the length of the volatile-activating bump 574 may be longer than the colorant-activating bumps 392–398. Alternatively, the volatile chamber 570 and associated bump 574 may be located closer to the hinge of lid 390 than the colorant chambers 312–318, so the volatile bump 574 contacts and breaks the chamber 570 before the colorant chamber is broken. In some implementations, it may be found that the desired amounts of stirring or mixing employed, for instance through use of the mechanisms of FIGS. 23–25, may be enhanced by first agitating or stirring slowly, followed by a faster stirring motion, or vice versa, and perhaps interspersed with one or more waiting periods where no stirring or vibratory activity occurs.

As mentioned with respect to FIG. 25, temperature may also play an important role in arriving the proper ink mixture. For instance, rather than having an externally mounted heating element 558, it may be desirable to provide these various ink containers with an internally mounted heating element, which is then electrically coupled to a power supply on the printer 30. Such a system may be most economically employed using the replaceable cartridges with ink carriage 50, which already receives electrical signals via the conductor strip 79.

Thus, by using this ink replenishment system for blending ink constituents at the time of use in a single ink container or reservoir, the individual colorants and/or other ink components are kept separate from the ink vehicle until the user selects which color ink is needed. At the time of use, the user manually, or automatically through the action of inserting the container into the printing mechanism 30, performs an action which causes the desired colorant and/or other ink components to be mixed with the ink vehicle, such as by rupturing a vial or chamber containing the desired colorant or other ink components, within the chamber containing the vehicle 105. The solution is then mixed by unaided diffusion, or aided by manual or automatic means after which it is ready for use to print images on the media 40.

We claim:

1. An ink replenishment system for an inkjet printing mechanism, comprising:

an ink reservoir removably receivable by the inkjet printing mechanism to deliver an ink composition to an inkjet printhead;

an ink vehicle contained within the reservoir;

an ink constituent mixable with the ink vehicle to obtain the ink composition; and an introduction mechanism that selectively introduces the ink constituent into the ink vehicle within the reservoir.

2. An ink replenishment system according to claim 1 wherein:

the ink replenishment system further includes an inkjet cartridge body;

the inkjet printhead is supported by the cartridge body; and the reservoir is housed inside the cartridge body.

3. An ink replenishment system according to claim 1 wherein:

the inkjet printhead comprises a printhead detachable from the reservoir; and the inkjet printing mechanism has a reservoir receptacle configured to removably receive the ink reservoir, and an ink delivery system to deliver the ink composition from the reservoir to the detachable printhead.

4. An ink replenishment system according to claim 1 wherein the ink constituent comprises a substance that, after mixture with the ink vehicle, forms an ink composition with a shelf life which degrades over time.

5. An ink replenishment system according to claim 4 wherein said substance comprises a volatile compound.

6. An ink replenishment system according to claim 1 wherein:

the ink constituent comprises a first constituent;

the ink replenishment system further includes a second ink constituent mixable with the ink vehicle to obtain the ink composition; and a second introduction mechanism that selectively introduces the second ink constituent into the ink vehicle within the reservoir.

7. An ink replenishment system according to claim 6 wherein:

the first constituent comprises a first colorant; and the second ink constituent comprises a second colorant different from the first colorant.

8. An ink replenishment system according to claim 6 wherein the second ink constituent comprises a substance that, after mixture with the ink vehicle, forms an ink composition with a shelf life which degrades over time.

9. An ink replenishment system according to claim 6 wherein:

the ink replenishment system further includes a third ink constituent mixable with the ink vehicle to obtain the ink composition;

a third introduction mechanism that selectively introduces the third ink constituent into the ink vehicle within the reservoir;

the ink replenishment system further includes a fourth ink constituent mixable with the ink vehicle to obtain the ink composition; and a fourth introduction mechanism that selectively introduces the fourth ink constituent into the ink vehicle within the reservoir.

10. An ink replenishment system according to claim 6 wherein the ink replenishment system further includes a lock-out mechanism that, after introduction of the first ink constituent into the ink vehicle, prevents the introduction of the second ink constituent into the ink vehicle.

11. An ink replenishment system according to claim 6 wherein the ink replenishment system further includes an indication mechanism that indicates after introduction of one of the first or second ink constituents into the ink vehicle, which of the first or the second constituent was introduced.

12. An ink replenishment system according to claim 1 wherein the ink replenishment system further includes a mixing mechanism that, after introduction of the ink constituent, mixes the ink constituent with the ink vehicle.

13. An ink replenishment system according to claim 1 wherein the ink constituent comprises a cleansing substance.

14. An ink replenishment system according to claim 1 wherein the ink constituent comprises a mixture of a colorant and a substance having a shelf life which degrades over time after mixture with the ink vehicle.

15. An ink replenishment system according to claim 1 wherein the ink constituent comprises a liquid substance.

16. An ink replenishment system according to claim 1 wherein the ink constituent comprises a solid pelletized substance dissolvable by the ink vehicle.

17. An ink replenishment system according to claim 1 wherein the ink constituent comprises a granular substance dissolvable by the ink vehicle.

18. An ink replenishment system according to claim 1 wherein the ink constituent comprises a solid tablet dissolvable by the ink vehicle.

19. An ink replenishment system according to claim 1 wherein the ink vehicle includes a volatile compound.

20. An ink replenishment system according to claim 1 wherein:

the ink reservoir includes an inlet; and the introduction mechanism comprises a container which introduces the ink constituent therein into the ink vehicle through the reservoir inlet.

21. An ink replenishment system according to claim 20 wherein the ink constituent comprises a liquid substance.

22. An ink replenishment system according to claim 20 wherein:

the inkjet printhead comprises a printhead detachable from the reservoir; and the inkjet printing mechanism has a reservoir receptacle configured to removably receive the ink reservoir, and an ink delivery system to deliver the ink composition from the reservoir to the detachable printhead.

23. An ink replenishment system according to claim 20 wherein the ink replenishment system further includes plural introduction mechanisms each comprising a container external to the reservoir to selectively introduce an ink constituent into the ink vehicle through the reservoir inlet, with each of the plural introduction mechanisms containing different ink constituents that are isolated from the ink vehicle by the plural introduction mechanisms prior to introduction.

24. An ink replenishment system according to claim 23 wherein:

each of the different ink constituents comprises a colorant which upon introduction into the ink vehicle produce ink compositions of different colors; and the ink reservoir includes a visual indication device to determine the color of the ink composition produced after introduction of one of the ink constituents into the ink vehicle.

25. An ink replenishment system according to claim 1 wherein the introduction mechanism comprises:

a rippable container containing the ink constituent, with the rippable container located inside the reservoir, and with the rippable container having a tear strip sealing an openable portion of the container; and a pull cord coupled to the tear strip, with the pull cord being of a length so when pulled, the tear strip rips open the openable portion of the container to expose the ink constituent to the ink vehicle.

26. An ink replenishment system according to claim 25 wherein the reservoir comprises a flexible container.

27. An ink replenishment system according to claim 25 wherein the ink constituent comprises a solid pelletized substance dissolvable by the ink vehicle.

28. An ink replenishment system according to claim 25 wherein the ink constituent comprises a granular substance dissolvable by the ink vehicle.

29. An ink replenishment system according to claim 25 wherein the ink constituent comprises a solid tablet dissolvable by the ink vehicle.

30. An ink replenishment system according to claim 25 further including:

plural rippable containers located inside the reservoir, with each rippable container containing different ink constituents; and plural pull cords each associated with one of the plural rippable containers.

31. An ink replenishment system according to claim 30 wherein:

each of the different ink constituents comprises a colorant which upon introduction into the ink vehicle produce ink compositions of different colors; and each of the plural pull cords includes indicia indicative of the color of the ink composition produced after introduction of the associated ink constituent into the ink vehicle, with the pull cord following introduction having a longer apparent length than before introduction to provide an indication of which ink constituent has been introduced into the vehicle.

32. An ink replenishment system according to claim 30 wherein:

each of the different ink constituents comprises a colorant which upon introduction into the ink vehicle produce ink compositions of different colors; and the ink reservoir includes a transparent portion to visually determine the color of the ink composition produced after introduction of one of the ink constituents into the ink vehicle.

33. An ink replenishment system according to claim 30 wherein:

the inkjet printhead comprises a printhead detachable from the reservoir; and the inkjet printing mechanism has a reservoir receptacle configured to removably receive the ink reservoir, and an ink delivery system to deliver the ink composition from the reservoir to the detachable printhead.

34. An ink replenishment system according to claim 25 wherein:

the reservoir comprises a flexible container having an expandable portion formed therein, and opposing external and internal surfaces;

the tear strip is tethered to the internal surface of the flexible container at the expandable portion; and to attach the pull cord to the tear strip, the pull cord is attached to the external surface of the flexible container at the expandable portion, with the expandable portion expanding when the pull cord is pulled to rip open the rippable container.

35. An ink replenishment system according to claim 1 wherein the introduction mechanism comprises a breakable container located inside the reservoir.

36. An ink replenishment system according to claim 35 wherein the breakable container is of a brittle plastic.

37. An ink replenishment system according to claim 35 wherein the breakable container is of a glass.

38. An ink replenishment system according to claim 37 wherein the breakable container comprises a glass vial.

39. An ink replenishment system according to claim 35 wherein:

the breakable container is secured at a location within the reservoir;

the reservoir comprises a squeezable container; and the breakable container is of a material which ruptures upon squeezing the reservoir adjacent the location of the breakable container.

40. An ink replenishment system according to claim 39 further including plural breakable containers secured at different locations inside the reservoir, with each breakable container containing different ink constituents.

41. An ink replenishment system according to claim 40 wherein:

each of the different ink constituents comprises a colorant which upon introduction into the ink vehicle produce ink compositions of different colors; and the reservoir has an external surface with indicia located thereon adjacent the location of an associated breakable container, with each of the indicia being indicative of the color of the ink composition produced after introduction of the associated ink constituent into the ink vehicle.

42. An ink replenishment system according to claim 40 wherein the ink reservoir includes a transparent portion to visually determine the color of the ink composition produced after introduction of one of the ink constituents into the ink vehicle.

43. An ink replenishment system according to claim 39 wherein:

the inkjet printhead comprises a printhead detachable from the reservoir; and the inkjet printing mechanism has a reservoir receptacle configured to removably receive the ink reservoir, and an ink delivery system to deliver the ink composition from the reservoir to the detachable printhead.

44. An ink replenishment system according to claim 1 wherein the introduction mechanism comprises a piercable container located inside the reservoir and a piercing mechanism activatable to pierce the piercable container.

45. An ink replenishment system according to claim 1 wherein the introduction mechanism comprises:

an openable container that substantially isolates the ink constituent therein from the ink vehicle prior to introduction; and a support mechanism that holds the openable container within the reservoir in a position for opening prior to introduction.

46. An ink replenishment system according to claim 45 wherein:

the openable container comprises a breakable container; and the introduction mechanism further comprises a breaker device and a pushing device to selectively push the breakable container and breaker device together so the breaker device breaks the breakable container to introduce the ink constituent into the ink vehicle.

47. An ink replenishment system according to claim 46 wherein:

the reservoir has a wall; and the pushing device has an external portion extending from inside the reservoir through the reservoir wall for selective activation to push the breakable container and breaker device together.

48. An ink replenishment system according to claim 47 wherein:

ink replenishment system further includes plural breakable containers each associated with a breaker device, with the plural breakable containers secured at different locations inside the reservoir, and with each breakable container containing different ink constituents; and the pushing device is selectively engageable with a selected one of the plural breakable containers to introduce the ink constituent contained therein into the ink vehicle.

49. An ink replenishment system according to claim 48 wherein:

each of the different ink constituents comprises a colorant which upon introduction into the ink vehicle produce ink compositions of different colors; and the external portion of the pushing device has indicia located thereon indicative of the color of the ink composition produced after engagement of the pushing device with said selected one of the plural breakable containers to introduce the ink constituent contained therein into the ink vehicle.

50. An ink replenishment system according to claim 49 further including a lock-out mechanism that, after introduction of the one colorant into the ink vehicle, prevents the introduction of another colorant into the ink vehicle.

51. An ink replenishment system according to claim 50 wherein:

the reservoir wall has an exterior surface with a selection indicia located thereon for cooperative indication with the indicia located on the external portion of the pushing device to indicate which color of ink composition has been produced by the introduction of the one colorant into the ink vehicle; and the lock-out mechanism secures the external portion of the pushing device at the selection indicia to provide a permanent record of the color of ink composition that has been produced.

52. An ink replenishment system according to claim 47 further including:

plural breakable containers each associated with a breaker device, with the plural breakable containers secured at different locations inside the reservoir, and with each breakable container containing different ink constituents; and plural pushing devices each selectively engageable with an associated one of the plural breakable containers to introduce the ink constituent contained therein into the ink vehicle.

53. An ink replenishment system according to claim 52 wherein the ink replenishment system further includes a lock-out mechanism that, after introduction of one ink constituent into the ink vehicle, prevents the introduction of another ink constituent into the ink vehicle.

54. An ink replenishment system according to claim 52 further including an indication mechanism that, after introduction of one constituent into the ink vehicle holds the pushing device associated therewith in an activated state to provide a record of which ink constituent has been introduced into the vehicle.

55. An ink replenishment system according to claim 45 wherein:

the reservoir comprises a squeezable container; and the introduction mechanism further includes an opening device, a support member supporting the opening device, and a biasing member that biases the support mechanism and the support member in an inactivated position prior to introduction, and with the biasing member being stressed through squeezing of the squeezable container to bring the opening device into opening contact with the openable container for introduction.

56. An ink replenishment system according to claim 55 wherein:

the openable container comprises a piercable container; and the opening device comprises a piercing member which pierces the piercable container during said opening contact.

57. An ink replenishment system according to claim 55 wherein:

the openable container comprises a rupturable container; and the opening device comprises a rupturing member which ruptures the rupturable container during said opening contact.

58. An ink replenishment system according to claim 55 wherein:

the openable container comprises a breakable container; and the opening device comprises a breaker member which breaks the breakable container during said opening contact.

59. An ink replenishment system according to claim 55 wherein:

the openable container comprises a glass vial; and the opening device comprises a breaker member which breaks the glass vial during said opening contact.

60. An ink replenishment system according to claim 55 further including:

plural openable containers each containing different ink constituents; and plural collapsible devices each associated one of the plural openable containers to introduce the ink constituent contained therein into the ink vehicle.

61. An ink replenishment system according to claim 60 wherein:

a first one of the plural openable containers contains an ink constituent comprising a first colorant;

a second one of the plural openable containers contains an ink constituent comprising a second colorant; and the squeezable container has a transparent portion for visual inspection to determine whether the first colorant or the second colorant has been introduced into the vehicle.

62. An ink replenishment system according to claim 55 wherein:

the opening device comprises a spike member;

the second member comprises a retainer base that receives and retains the first member;

the first member substantially surrounds the openable container, with the first member defining a spike receiving hole therethrough through which the spike member slides to open the openable container during said opening contact; and at least one of the first and second members defines a fluid passageway therethrough for introduction of the ink constituent into the vehicle.

63. An ink replenishment system according to claim 55 wherein:

the inkjet printhead comprises a printhead detachable from the reservoir; and the inkjet printing mechanism has a reservoir receptacle configured to removably receive the squeezable container, and an ink delivery system to deliver the ink composition from the squeezable container to the detachable printhead.

64. An ink replenishment system according to claim 1 wherein:

the ink replenishment system further includes plural ink reservoirs defined by a body that is removably receivable by the inkjet printing mechanism, with each of the plural ink reservoirs containing a portion of the ink vehicle;

the ink replenishment system further includes a first set of ink constituents and a second set of ink constituents;

the introduction mechanism comprises:

a first set of plural openable containers each supported within an associated one of the plural ink reservoirs in a first opening position prior to introduction, with the first set of plural openable containers isolating the first set of ink constituents therein prior to introduction;

a second set of plural openable containers each supported within an associated one of the plural ink reservoirs in a second opening position prior to introduction, with the second set of plural openable containers isolating the second set of ink constituents therein prior to introduction; and an opening device selectively positionable to the first opening position for activation to open the first set of plural openable containers to introduce the first set of ink constituents into the ink vehicle, and with the opening device also being selectively positionable to the second opening position for activation to open the second set of plural openable containers to introduce the second set of ink constituents into the ink vehicle.

65. An ink replenishment system according to claim 64 wherein the ink replenishment system further includes a lock-out mechanism that, after introduction of the first set of ink constituents into the ink vehicle, prevents the introduction of the second set of ink constituents into the ink vehicle.

66. An ink replenishment system according to claim 64 wherein the ink replenishment system further includes an indication mechanism that indicates after introduction of one of the first or second sets of ink constituents into the ink vehicle, which of the first or the second sets of constituent was introduced into the ink vehicle.

67. An ink replenishment system according to claim 64 wherein:

the plural openable containers of the first and second sets each comprise a breakable container; and the opening device comprises a rotary selection switch having an internal portion extending into the each of the plural reservoirs to break the first set of breakable containers when in the first opening position, and to break the second set of breakable containers when in the second opening position.

68. An ink replenishment system according to claim 64 wherein:

the first set of ink constituents comprises a first set of colorants each having a colorant concentration when introduced into the vehicle; and the second set of ink constituents comprises a second set of colorants each having a another colorant concentration when introduced into the vehicle, with said another colorant concentration being different from the colorant concentration of the first set of colorants.

69. An ink replenishment system according to claim 64 wherein:

the body comprises an inkjet cartridge body; and the inkjet printhead is supported by the cartridge body, with the printhead having plural sets of nozzles which selectively eject the ink compositions from an associated one of the plural reservoirs.

70. An ink replenishment system according to claim 1, further including an internal mixing member located inside the reservoir to mix the ink constituent with the vehicle after introduction.

71. An ink replenishment system according to claim 70 wherein the internal mixing member is of a magnetic material mounted inside the reservoir for relative motion with respect the reservoir in response to motion of an external magnetic member.

72. An ink replenishment system according to claim 71 wherein the internal mixing member of a magnetic material is pivotally mounted inside the reservoir for rotary motion.

73. An ink replenishment system according to claim 70 wherein the internal mixing member is mounted inside the reservoir for relative motion with respect to the reservoir in response to motion the reservoir.

74. An ink replenishment system according to claim 73 wherein the internal mixing member comprises a pendulum member pivotally mounted inside the reservoir for a swinging motion.

75. An inkjet printing mechanism, comprising:

an inkjet printhead that selectively ejects an ink composition to print an image;

a receptacle;

an ink reservoir removably receivable by the receptacle to deliver the ink composition to the inkjet printhead;

an ink vehicle contained within the reservoir;

an ink constituent mixable with the ink vehicle to obtain the ink composition; and an openable container located inside the reservoir that substantially isolates the ink constituent therein from the ink vehicle before the container is opened to introduce the ink constituent into the ink vehicle.

76. An inkjet printing mechanism according to claim 75 wherein:

the reservoir is housed inside an inkjet cartridge body that supports inkjet printhead; and the receptacle comprises a carriage that removably receives the cartridge body.

77. An inkjet printing mechanism according to claim 75 wherein:

the inkjet printhead comprises a printhead detachable from the reservoir;

the reservoir receptacle is located remote from the detachable printhead; and the inkjet printing mechanism further includes an ink delivery system to deliver the ink composition from the reservoir to the detachable printhead.

78. An inkjet printing mechanism according to claim 75 wherein the ink constituent comprises a liquid substance.

79. An inkjet printing mechanism according to claim 75 wherein the ink constituent comprises a solid substance dissolvable by the ink vehicle.

80. An inkjet printing mechanism according to claim 75 wherein the ink vehicle includes a volatile compound.

81. An inkjet printing mechanism according to claim 75 wherein the ink constituent comprises a mixture of a colorant and a substance having a shelf life which degrades over time after mixture with the ink vehicle.

82. An inkjet printing mechanism according to claim 75 wherein the ink constituent comprises a colorant.

83. An inkjet printing mechanism according to claim 82 further including:

a second ink constituent mixable with the ink vehicle to obtain the ink composition; and a second openable container located inside the reservoir that substantially isolates the second ink constituent therein from the ink vehicle before the second container is opened to introduce the second ink constituent into the ink vehicle.

84. An inkjet printing mechanism according to claim 83 further including:

a third ink constituent mixable with the ink vehicle to obtain the ink composition;

a third openable container located inside the reservoir that substantially isolates the third ink constituent therein from the ink vehicle before the third container is opened to introduce the third ink constituent into the ink vehicle;

a fourth ink constituent mixable with the ink vehicle to obtain the ink composition; and a fourth openable container located inside the reservoir that substantially isolates the fourth ink constituent therein from the ink vehicle before the fourth container is opened to introduce the second ink constituent into the ink vehicle.

85. An inkjet printing mechanism according to claim 83 further including a lock-out mechanism that, after introduction of the first ink constituent into the ink vehicle, prevents the introduction of the second ink constituent into the ink vehicle.

86. An inkjet printing mechanism according to claim 83 further including an indication mechanism that indicates after introduction of one of the first or second ink constituents into the ink vehicle, which of the first or the second constituent was introduced.

87. An inkjet printing mechanism according to claim 83 wherein the second ink constituent comprises a second colorant different from the first colorant.

88. An inkjet printing mechanism according to claim 87 wherein the ink reservoir includes a transparent portion to visually determine the color of the ink composition produced after introduction of one of the ink constituents into the ink vehicle.

89. An inkjet printing mechanism according to claim 75 wherein the openable container comprises a rippable container having a tear strip sealing an openable portion of the container, and a pull cord coupled to the tear strip, with the pull cord being of a length so when pulled, the tear strip rips open the openable portion of the container to expose the ink constituent to the ink vehicle.

90. An inkjet printing mechanism according to claim 75 wherein the openable container comprises a piercable container and a piercing mechanism activatable to pierce the piercable container.

91. An inkjet printing mechanism according to claim 75 wherein the openable container comprises a breakable container.

92. An inkjet printing mechanism according to claim 75 wherein:

the openable container is secured at a location within the reservoir;

the reservoir comprises a squeezable container; and the openable container is of a material which ruptures upon squeezing the reservoir adjacent the location of the openable container.

93. An inkjet printing mechanism according to claim 92 further including plural openable containers secured at different locations inside the reservoir, with each openable container containing different ink constituents.

94. An inkjet printing mechanism according to claim 75 wherein:

the inkjet printing mechanism further includes plural inkjet printheads, plural ink reservoirs each in fluid communication with an associated one of the plural inkjet printheads, and plural openable containers, with at least two of the plural openable containers containing different ink constituents being secured at different locations inside each of the plural reservoirs;

each of the different ink constituents inside a reservoir comprises a colorant which upon introduction into the ink vehicle produce ink compositions of different colors; and the receptacle removably receives all of the plural ink reservoirs.

95. An inkjet printing mechanism according to claim 94 wherein the receptacle includes an introduction mechanism that selectively opens one openable container for each of the plural reservoirs when installed therein to introduce a selected colorant into the ink vehicle within each reservoir.

96. An inkjet printing mechanism according to claim 95 wherein:

the inkjet printing mechanism further includes another openable container containing an additional ink constituent; and the receptacle introduction mechanism also opens said another openable container when opening any one of said plural colorant-containing openable containers to also introduce said additional ink constituent into the ink vehicle within each reservoir.

97. An inkjet printing mechanism according to claim 95 wherein:

each reservoir comprises a squeezable container;

each openable container is of a material which ruptures upon squeezing the reservoir adjacent the location of the openable container; and the receptacle introduction mechanism includes a squeezing device that selectively squeezes and ruptures one openable container for each of the plural reservoirs when installed therein.

98. An inkjet printing mechanism according to claim 95 wherein:

each openable container comprises a breakable container;

the inkjet printing mechanism further includes a breaker device and plural pushing devices each associated with one of the plural breakable containers to selectively push the associated breakable container and breaker device together until the breakable container releases the constituent into the ink vehicle; and the receptacle introduction mechanism includes an activator that selectively engages one of the plural pushing devices to break one breakable container for each of the plural reservoirs when installed therein.

99. An inkjet printing mechanism according to claim 95 wherein each reservoir further includes a lock-out mechanism that, after introduction of one ink constituent into the ink vehicle, prevents the introduction of another ink constituent into the ink vehicle.

100. An inkjet printing mechanism according to claim 75 wherein:

the reservoir comprises a squeezable container;

the openable container is supported inside the reservoir by a support mechanism; and the introduction mechanism further includes an opening device, a support member supporting the opening device, and a biasing member that biases the support mechanism and the support member in an inactivated position prior to introduction, with the biasing member being stressed through squeezing of the squeezable container to bring the opening device into opening contact with the openable container for introduction.

101. An inkjet printing mechanism according to claim 75 further including a mixing mechanism that, after introduction of the ink constituent, mixes the constituent with the ink vehicle.

102. An inkjet printing mechanism according to claim 101 wherein:

the inkjet printhead comprises a printhead detachable from the reservoir;

the reservoir receptacle is located remote from the detachable printhead;

the inkjet printing mechanism further includes an ink delivery system to deliver the ink composition from the reservoir to the detachable printhead; and the mixing mechanism comprises a vibratory mechanism coupled to the reservoir receptacle to vibrate the receptacle to mix the constituent with the ink vehicle.

103. An inkjet printing mechanism according to claim 101 wherein the mixing mechanism comprises an internal mixing member located inside the reservoir.

104. An inkjet printing mechanism according to claim 103 wherein:

the mixing mechanism comprises a moveable external magnetic member; and the internal mixing member is of a magnetic material mounted inside the reservoir for relative motion with respect the reservoir in response to motion of the external magnetic member.

105. An inkjet printing mechanism according to claim 104 wherein:

the mixing mechanism further comprises motor that rotates the external magnetic member; and the magnetic internal mixing member is mounted for rotational motion inside the reservoir to stir the ink constituent and the ink vehicle.

106. An inkjet printing mechanism according to claim 103 wherein the internal mixing member is mounted inside the reservoir for relative motion with respect the reservoir in response to motion the reservoir.

107. An inkjet printing mechanism according to claim 106 wherein:

the reservoir is housed inside an inkjet cartridge body that supports the inkjet printhead; and the receptacle comprises a reciprocating carriage that removably receives the cartridge body, with the reciprocating carriage motion inducing movement of the internal mixing member inside the reservoir.

108. An inkjet printing mechanism according to claim 106 wherein the mixing mechanism comprises a movement mechanism coupled to the reservoir receptacle to move the receptacle and reservoir when installed therein to move the internal mixing member inside the reservoir.

109. An inkjet printing mechanism according to claim 108 wherein the internal mixing member comprises a pendulum member pivotally mounted inside the reservoir for a swinging motion in response to movement of the receptacle.

110. An inkjet printing mechanism according to claim 75, further including a heating element located adjacent the receptacle to heat the ink vehicle within the ink reservoir.

111. A method of replenishing an ink supply of an inkjet printing mechanism by combining plural ink components of an ink composition at the time of use, comprising the steps of:

providing plural ink components comprising an ink vehicle and plural ink constituents, wherein the providing step comprises providing plural reservoirs each containing:

(a) an ink vehicle, (b) one of a first set of rupturable containers containing a first set of ink constituents, and (c) one of a second set of rupturable containers containing a second set of ink constituents;

selecting one of the plural ink constituents by selecting either the first or the second set of ink constituents;

introducing the selected ink constituent into the vehicle by introducing the selected set of ink constituents into each of the plural reservoirs; and mixing the introduced ink constituent with the vehicle to produce the ink composition.

112. A method of replenishing an ink supply of an inkjet printing mechanism by combining plural ink components of an ink composition at the time of use, comprising the steps of:

providing plural ink components comprising an ink vehicle and plural ink constituents, wherein the providing step comprises providing the ink vehicle in a reservoir;

selecting one of the plural ink constituents;

introducing the selected ink constituent into the vehicle, wherein the introducing step comprises releasing the selected ink constituent into the reservoir; and mixing the introduced ink constituent with the vehicle to produce the ink composition, wherein the mixing step comprises the step of agitating the reservoir.

113. A method according to claim 112 wherein the agitating step comprises the step of manually shaking the reservoir.

114. A method according to claim 112 wherein:

the reservoir of the providing step is removably installable in a component of the inkjet printing mechanism;

the method further includes the step of installing the reservoir in a component of the inkjet printing mechanism; and after the installing step, the agitating step comprises the step of moving the reservoir with the component of the inkjet printing mechanism.

115. A method according to claim 114 wherein:

said component of the inkjet printing mechanism in the installing step comprises a reservoir receptacle located remote from a printhead of the inkjet printing mechanism, wherein the printhead is detachable from the reservoir; and after the mixing step, the method further includes the step of delivering the ink composition from the reservoir to the detachable printhead.

116. A method of replenishing an ink supply of an inkjet printing mechanism by combining plural ink components of an ink composition at the time of use, comprising the steps of:

providing plural ink components comprising an ink vehicle and plural ink constituents, wherein the providing step comprises providing the ink vehicle in a reservoir comprising a replaceable inkjet cartridge that is removably installable in a reciprocating carriage of the inkjet printing mechanism;

selecting one of the plural ink constituents;

introducing the selected ink constituent into the vehicle;

mixing the introduced ink constituent with the vehicle to produce the ink composition;

installing the cartridge in the carriage; and after the installing step, the mixing step comprises the step of reciprocating the carriage.

117. A method of replenishing an ink supply of an inkjet printing mechanism by combining plural ink components of an ink composition at the time of use, comprising the steps of:

providing plural ink components comprising an ink vehicle and plural ink constituents, wherein the providing step comprises providing the ink vehicle in a reservoir that is removably installable in a moveable receptacle of the inkjet printing mechanism;

selecting one of the plural ink constituents;

introducing the selected ink constituent into the vehicle;

mixing the introduced ink constituent with the vehicle to produce the ink composition;

installing the reservoir in the receptacle; and after the installing step, the mixing step comprises the step of vibrating the receptacle.

118. A method of replenishing an ink supply of an inkjet printing mechanism by combining plural ink components of an ink composition at the time of use, comprising the steps of:

providing plural ink components comprising an ink vehicle and plural ink constituents, wherein the providing step comprises providing the ink vehicle in a reservoir that is removably installable in the inkjet printing mechanism, and providing a moveable mixing member inside the reservoir;

selecting one of the plural ink constituents;

introducing the selected ink constituent into the vehicle;

mixing the introduced ink constituent with the vehicle to produce the ink composition;

installing the reservoir in the inkjet printing mechanism; and after the installing step, the mixing step comprises the step of stirring the ink constituent and the vehicle together by moving moveable mixing member.

119. A method according to claim 118 wherein:

the providing step comprises providing the moveable mixing member as a magnetic member;

the installing step comprises the step of installing the reservoir in the inkjet printing mechanism having a moveable magnetic flux source; and after the installing step, the mixing step comprises the step of moving the magnetic flux source of the inkjet printing mechanism, and in response thereto, moving the magnetic member inside the reservoir.

120. A method according to claim 118 wherein:

the providing step comprises providing the ink vehicle in a reservoir that is removably installable in a moveable receptacle of the inkjet printing mechanism, and providing the moveable mixing member as a swinging member pivotally attached within the reservoir;

the method further includes the step of installing the reservoir in the receptacle; and after the installing step, the mixing step comprises the step of moving the receptacle, and in response thereto, moving the swinging member inside the reservoir.

121. A method according to claim 111 wherein the providing step comprises providing three reservoirs, and providing the first set of ink constituents comprising colorants for ink compositions having colorant concentration when introduced into the vehicle, and the second set of ink constituents comprising colorants for ink compositions having another concentration when introduced into the vehicle different from the colorant concentration of the first set of ink constituents; and the selecting step comprises the step of selecting the first set of ink constituents for printing images with a first print characteristic and selecting the second set of ink constituents for printing images with a second print characteristic.

122. A method of replenishing an ink supply of an inkjet printing mechanism by combining plural ink components of an ink composition at the time of use, comprising the steps of:

providing plural ink components comprising an ink vehicle and plural ink constituents, wherein the providing step comprises providing the ink vehicle in a reservoir having an inlet, and providing each of the plural ink constituents in an associated one of plural containers which introduce the ink constituent contained therein into the ink vehicle through the reservoir inlet;

selecting one of the plural ink constituents;

introducing the selected ink constituent into the vehicle by injecting the selected ink constituent into the reservoir through the reservoir inlet; and mixing the introduced ink constituent with the vehicle to produce the ink composition.

123. A method according to claim 122 wherein:

the providing step comprises providing the ink vehicle in said reservoir, with said reservoir having a visual indication device, and providing each of the plural ink constituents as a colorant to produce ink compositions of different colors upon introduction to the vehicle; and the method further includes the step visually inspecting the reservoir visual indication device to determine the color of the ink composition produced after the introducing step.

124. A method according to claim 122 wherein the providing step comprises providing each of the plural ink constituents as a liquid substance.

125. A method of replenishing an ink supply of an inkjet printing mechanism by combining plural ink components of an ink composition at the time of use, comprising the steps of:

providing plural ink components comprising an ink vehicle and plural ink constituents, wherein the providing step comprises providing the ink vehicle in a reservoir and each of the plural ink constituents in an openable container located inside the reservoir;

selecting one of the plural ink constituents;

introducing the selected ink constituent into the vehicle by opening the container that contains the selected ink constituent; and mixing the introduced ink constituent with the vehicle to produce the ink composition.

126. A method according to claim 125 wherein:

the providing step comprises providing each openable container as a rippable container having a tear strip sealing an openable portion of the container; and the introducing step comprises the step of pulling the tear strip to open the openable portion of the rippable container that contains the selected ink constituent.

127. A method according to claim 126 wherein:

each of the different ink constituents comprises a colorant which upon introduction into the ink vehicle produce ink compositions of different colors;

the providing step comprises providing a pull cord attached to the tear strip, with each of the plural pull cords having indicia indicative of the color of the ink composition produced after introduction of the associated ink constituent into the ink vehicle; and the introducing step comprises the step of pulling the pull cord to open the rippable container, and leaving a permanent indication of which ink constituent has been introduced.

128. A method according to claim 125 wherein:

the providing step comprises providing each openable container as a breakable container; and the introducing step comprises the step of breaking the breakable container that contains the selected ink constituent.

129. A method according to claim 128 wherein:

the providing step comprises providing the reservoir as a squeezable container, with each breakable container being secured at a location within the reservoir; and the introducing step comprises the step of squeezing the reservoir to break the breakable container that contains the selected ink constituent.

130. A method according to claim 129 wherein step of squeezing the reservoir to break the breakable container that contains the selected ink constituent comprises manually squeezing the reservoir.

131. A method according to claim 129 wherein:

the method further includes the step of installing the reservoir into the inkjet printing mechanism; and step of squeezing the reservoir to break the breakable container that contains the selected ink constituent comprises squeezing the reservoir with a component of the inkjet printing mechanism during the installing step.

132. A method according to claim 131 wherein:

the method further includes the steps of selecting another ink constituent and introducing said another ink constituent into the ink vehicle; and step of squeezing the reservoir further includes the step of breaking the breakable container that contains said another ink constituent by squeezing the reservoir with a component of the inkjet printing mechanism during the installing step.

133. A method according to claim 129 wherein:

the providing step comprises providing a piercing mechanism adjacent each breakable container; and the introducing step comprises the step of squeezing the reservoir to pierce the selected breakable container with the piercing mechanism.

134. A method according to claim 128 wherein:

the providing step comprises securing each breakable container at a location within the reservoir adjacent an associated breaker device; and the introducing step comprises the step of activating the breaker device associated with the breakable container that contains the selected ink constituent.

135. A method according to claim 134 wherein:

the providing step comprises securing each breakable container at a location within the reservoir to be selectively contacted by a pusher device; and the introducing step comprises the step of the pushing the selected breakable container against the breaker device with the pusher device.

136. A method according to claim 135 wherein:

the providing step comprises supporting the pusher device on a rotary selector; and the selecting step comprises the step of rotating the rotary selector to align the pusher device with the breakable container that contains the selected ink constituent prior to the introducing step.

137. A method according to claim 134 wherein:

the providing step comprises securing each breakable container at a location within the reservoir to be selectively contacted by an associated one of plural pusher devices, and the providing step further comprises providing a locking mechanism operable with each of the plural pusher devices;

the introducing step comprises the step of the pushing the selected breakable container against the breaker device with said associated one of the plural pusher devices; and the method further includes the step of, after the introducing step, preventing the pushing of any other pusher device with the locking mechanism.

138. A method according to claim 137 wherein:

each of the different ink constituents comprises a colorant which upon introduction into the ink vehicle produce ink compositions of different colors;

the providing step comprises providing each pusher device with indicia indicative of the color of the ink composition produced after introduction of the associated ink constituent into the ink vehicle; and the method further includes the step of, after the introducing step, leaving a permanent indication of which ink constituent has been introduced.

* * * * *

UNITED STATES PATENT AND TRADEMARK OFFICE

CERTIFICATE OF CORRECTION

2PATENT NO. : 6,065,828
DATED : May 23, 2000
INVENTOR(S) : Lo et al.

It is certified that error appears in the above-identified patent and that said Letters Patent is hereby corrected as shown below:

Column 10
Line 41, after "However," insert --it--.

Column 13
Line 63, delete "202'208" and insert therefor --202-208--.

Column 15
Line 64, delete the second "364" and insert therefor --366--.

Column 17
Line 65, delete "he" and insert therefor --the--.

Column 22
Line 8, delete "3-27" and insert therefor --3-7--.

IN THE CLAIMS

Column 31
Line 33, after "respect" insert --to--.
Line 41, after "motion" insert --of--.

Column 34
Line 57, after respect" insert --to--.

Column 35
Line 1, after "respect" insert --to--.
Line 2, after "motion" insert --of--.

Column 36
Line 67, after "moving" insert --the--.

Column 38
Line 52, after "wherein" insert --the--.
Line 59, before "step" insert --the--.

UNITED STATES PATENT AND TRADEMARK OFFICE

CERTIFICATE OF CORRECTION

PATENT NO. : 6,065,828
DATED : May 23, 2000
INVENTOR(S) : Lo et al.

It is certified that error appears in the above-identified patent and that said Letters Patent is hereby corrected as shown below:

Column 39
Line 1, before "step" insert --the--.

Signed and Sealed this

Twelfth Day of June, 2001

Nicholas P. Godici

*Attest:*

*Attesting Officer*

NICHOLAS P. GODICI
*Acting Director of the United States Patent and Trademark Office*